US009573380B2

(12) United States Patent
Ishida et al.

(10) Patent No.: US 9,573,380 B2
(45) Date of Patent: Feb. 21, 2017

(54) LIQUID DISCHARGING APPARATUS

(71) Applicant: SEIKO EPSON CORPORATION, Tokyo (JP)

(72) Inventors: Masayuki Ishida, Nagano (JP); Shuichi Koganehira, Nagano (JP); Ryohei Ito, Nagano (JP); Masaki Tsukida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/041,391

(22) Filed: Feb. 11, 2016

(65) Prior Publication Data

US 2016/0279962 A1 Sep. 29, 2016

(30) Foreign Application Priority Data

Mar. 23, 2015 (JP) ..... 2015-059176
Mar. 31, 2015 (JP) ..... 2015-070958
Dec. 1, 2015 (JP) ..... 2015-234474

(51) Int. Cl.
*B41J 2/175* (2006.01)
*B41J 29/13* (2006.01)
*B41J 29/38* (2006.01)

(52) U.S. Cl.
CPC ..... *B41J 2/17566* (2013.01); *B41J 2/17513* (2013.01); *B41J 2/17553* (2013.01); *B41J 29/13* (2013.01); *B41J 29/38* (2013.01)

(58) Field of Classification Search
CPC ..... B41J 2/175; B41J 2/1752; B41J 2/17513; B41J 2/17546; B41J 2/17566; B41J 2002/17573;B41J 2002/17579; B41J 2002/17589
See application file for complete search history.

(56) References Cited

U.S. PATENT DOCUMENTS 4,432,005 A * 2/1984 Duffield ..... B41J 2/17566 347/36
6,019,450 A * 2/2000 Mochizuki ..... B41J 2/16532 347/23
6,267,474 B1 * 7/2001 Mochizuki ..... B41J 2/175 347/85
6,530,634 B1 * 3/2003 Hara ..... B41J 2/16508 347/108
6,796,627 B2 * 9/2004 Kimura ..... B41J 2/17509 347/7
8,313,183 B2 * 11/2012 Platt ..... B41J 2/17593 347/88
8,919,900 B2 12/2014 Yamagata et al.

FOREIGN PATENT DOCUMENTS

JP 2004-074694 A 3/2004
JP 2012-152995 A 8/2012

* cited by examiner

*Primary Examiner* — Anh T. N. Vo
(74) *Attorney, Agent, or Firm* — Global IP Counselors, LLP

(57) ABSTRACT

A printer which is configured so that an ink tank which accommodates ink is fixed and a user can refill the ink tank with the ink, includes one pair of electrodes which are disposed in the ink tank and serve as sensors for detecting whether or not the ink is present at a predetermined height (first threshold value). A control portion which controls the printer performs liquid presence detection to detect whether or not the ink is present at the predetermined height (first threshold value) by using the sensors, and performs initial filling which corresponds to the result of the detection.

14 Claims, 11 Drawing Sheets

LIQUID DISCHARGING APPARATUS

CROSS REFERENCES TO RELATED APPLICATIONS

The entire disclosure of Japanese Patent Application No. 2015-070958, filed Mar. 31, 2015 is incorporated by reference herein.

The entire disclosure of Japanese Patent Application No. 2015-059176, filed Mar. 23, 2015 is incorporated by reference herein.

The entire disclosure of Japanese Patent Application No. 2015-234474 filed Dec. 1, 2015 is incorporated by reference herein.

BACKGROUND

1. Technical Field

The present invention relates to a liquid discharging apparatus which discharges liquid to a discharged medium.

2. Related Art

An example of a liquid discharging apparatus includes an ink jet printer (hereinafter, simply referred to as a printer). In the printer, ink, which is an example of liquid, is accommodated in an ink tank which is an example of a liquid accommodation portion, and it is possible to perform printing by ejecting the ink from a printing head, which is an example of a liquid discharge head, onto a paper sheet which is an example of a discharged medium.

In addition, in the printer, there are a type (hereinafter, referred to as an "on-carriage type") in which an ink tank (cartridge) is loaded in a carriage provided with a printing head, and a type (hereinafter, referred to as an "off-carriage type") in which an ink tank is provided in an apparatus main body of a printer, independently from a carriage, and the ink is supplied from the ink tank via a printing head and an ink tube.

An example of the off-carriage type printer which is the latter is described in JP-A-2012-152995.

In the off-carriage type printer, when a user refills the ink tank which is fixed to the printer with the ink, it is not possible to manage when (at which timing) the user refills the ink tank with the ink, or how much the ink tank is refilled with the ink, and thus, it is not possible to appropriately perform ink residual amount management.

SUMMARY

An advantage of some aspects of the invention is to appropriately perform ink residual amount management in a printer which can be refilled with the ink.

According to a first aspect of the invention, there is provided a liquid discharging apparatus including: a liquid discharging unit which discharges liquid to a discharged medium; a liquid accommodation portion which is provided with a pouring port through which a user pours the liquid, and which accommodates the liquid; a sensor for detecting whether or not the level of the liquid in the liquid accommodation portion is equal to or greater than a first threshold value; and a control portion which performs control that corresponds to a result of the detection of the sensor.

In this aspect, since the sensor for detecting whether or not the level of the liquid in the liquid accommodation portion is equal to or greater than the first threshold value, and the control portion which performs the control that corresponds to the result of the detection of the sensor are provided, by detecting whether or not the level of the liquid in the liquid accommodation portion is equal to or greater than the first threshold value by the sensor, it is possible to appropriately perform the residual liquid amount management regardless of the aspect of refilling of the liquid to the liquid accommodation portion. In particular, it is possible to suppress the risk that the liquid discharging operation is performed without taking into account that the state of the liquid is that the usable amount has been exhausted (so-called "blank driving").

In the liquid discharging apparatus, initial filling of the liquid to the liquid discharging unit may be configured of a plurality of steps, and the control portion may postpone performing a step which is intended to be performed next when the result of the detection by the sensor is less than the first threshold value while each step that configures the initial filling is performed.

In this aspect, the initial filling of the liquid to the liquid discharging unit is configured of the plurality of steps, and the control portion postpones performing the step which is intended to be performed next when the result of the detection by the sensor is less than the first threshold value while each step that configures the initial filling is performed. Therefore, the residual amount of the liquid becomes zero while performing the initial filling, and it is possible to prevent generation of the so-called blank driving.

In the liquid discharging apparatus, the control portion may move on to performing the step which is intended to be performed next when the result of the detection by the sensor is equal to or greater than the first threshold value in a state where the performing of the step which is intended to be performed next had been postponed in the initial filling.

In this aspect, the control portion moves on to the performing of the step which is intended to be performed next when the result of the detection by the sensor is equal to or greater than the first threshold value in a state where the performing of the step which is intended to be performed next had been postponed in the initial filling. Therefore, it is possible to omit the step which has already been finished in the initial filling thereby becoming unnecessary, and thus, to avoid unnecessary consumption of the liquid.

In the liquid discharging apparatus, a plurality of liquid accommodation portions which accommodate plural types of liquid which are different from each other separately may be provided, and the control portion may postpone the performing of the step which is intended to be performed next when the result of the detection by the sensor with respect to at least one liquid accommodation portion among the plurality of liquid accommodation portions is less than the first threshold value while performing each step which configures the initial filling.

In this aspect, the control portion postpones the performing of the step which is intended to be performed next when the result of the detection by the sensor with respect to at least one liquid accommodation portion among the plurality of liquid accommodation portions is less than the first threshold value while performing each step which configures the initial filling. Therefore, it is possible to prevent the generation of the so-called blank driving with respect to all of the plural types of liquid which are different from each other.

In the liquid discharging apparatus, the consumption amount in a step where the consumption amount of the liquid is the largest among the plurality of steps which configure the initial filling may be less than a residual amount of the liquid in the first threshold value in the liquid accommodation portion.

In this aspect, the consumption amount in the step where the consumption amount of the liquid is the largest among the plurality of steps which configure the initial filling is less than the residual amount of the liquid in the first threshold value in the liquid accommodation portion. Therefore, it is possible to prevent the amount of the liquid from becoming zero while performing the step, even though a residual amount level of the liquid in the liquid accommodation portion is equal to or greater than the first threshold value.

In the liquid discharging apparatus, a display portion which performs various types of display with respect to the user may be provided, and the control portion may display contents related to the result of the detection on the display portion when the result of the detection by the sensor is at least less than the first threshold value.

In this aspect, the control portion displays the contents related to the result of the detection on the display portion when the result of the detection by the sensor is at least less than the first threshold value. Therefore, usability is improved.

In the liquid discharging apparatus, the control portion may perform reset processing of making a count value return to an initial value when the consumption amount of the liquid reaches a predetermined amount which exceeds the consumption amount when the liquid is consumed to the residual amount level that corresponds to the first threshold value compared to a state where the liquid accommodation portion is completely filled with the liquid, in a state where the result of the detection by the sensor is equal to or greater than the first threshold value.

In this aspect, the reset processing of making the count value return to an initial value is performed when the consumption amount of the liquid reaches the predetermined amount which exceeds the consumption amount when the liquid is consumed to the residual amount level that corresponds to the first threshold value compared to a state where the liquid accommodation portion is completely filled with the liquid, in a state where the result of the detection by the sensor is equal to or greater than the first threshold value. Therefore, it is possible to prevent an overflow of the count value.

Furthermore, the invention can achieve each of the following application examples.

Application Example 1

According to this application example, there is provided a liquid consuming apparatus to which a liquid container that accommodates liquid is fixed, and in which a user can refill the liquid container with the liquid, the apparatus including: a consumption amount calculation portion which calculates the consumption amount of the liquid, a storage portion which stores a count value that is updated based on the consumption amount of the liquid calculated by the consumption amount calculation portion; a sensor which is disposed in the liquid container and detects whether or not the liquid is present at a predetermined position in the liquid container; and a control portion which performs liquid presence detection of whether or not the liquid is present by the sensor, in which the control portion performs reset processing when it is determined that the liquid is present by performing the liquid presence detection before performing the reset processing of making the count value return to the initial value.

In this configuration, the liquid consuming apparatus is configured so that the user can refill the liquid container with the liquid, detects whether or not the liquid is present at the predetermined position in the liquid container by the sensor, and performs residual liquid amount management, in addition to obtaining the count value by a dot count method. Therefore, since it is possible to detect the decrease in the residual amount of the liquid by the sensor, even when a deviation between the count value and an actual consumption value of the liquid is generated, it is possible to suppress the risk that a blank driving is generated compared to a case where the residual liquid amount management is performed only by the count value. In addition, for example, as the user refills the liquid, in a case where the actual residual amount of the liquid is greater than the residual amount of the liquid based on the count value, the control portion makes the count value return to the initial value, even when the user does not input an operation command, if it is determined that the liquid is present by performing the liquid presence detection. Therefore, an incorrect warning that the residual amount of the liquid is not present based on the count value, even though the actual residual amount of the liquid is present, is not generated. Accordingly, the user can continuously use the liquid consuming apparatus without paying close attention to the timing of refilling the liquid, the amount of the liquid when refilling, or the input operation, and it is possible to suppress the risk that the blank driving is generated, even under such a using condition.

Application Example 2

In the liquid consuming apparatus according to the application example, the control portion may determine that the liquid is present by performing the liquid presence detection, and may perform the reset processing when the count value is equal to or greater than the value which corresponds to a volume of the liquid container.

In this configuration, the control portion determines that the liquid is present by performing the liquid presence detection, and performs the reset processing when the updated count value is equal to or greater than the value which corresponds to the volume of the liquid container. When it is determined that the liquid is present, even though it is assumed that the amount of the liquid which is equal to or greater than the volume of the liquid container is consumed based on the count value, it is considered that a substantial deviation is generated between the count value and the actual consumption value. In this case, by performing the reset processing, even when the user does not input an operation command, it is possible to prevent an incorrect warning that the residual amount of the liquid is not present based on the count value, even though the actual residual amount of the liquid is present, from being repeatedly generated.

Application Example 3

In the liquid consuming apparatus according to the application example, a sensor end flag which is set when the control portion performs the liquid present detection and determines that the liquid is not present, may be provided, and the control portion may perform the reset processing in a case where the sensor end flag is set, the count value after the sensor end based on the consumption amount of the liquid computed from the time when it is lastly determined that the liquid is present before the sensor end flag is set, becomes equal to or greater than a first predetermined value, and it is determined that the liquid is present by performing the liquid presence detection.

In this configuration, a case where the sensor end flag is set means that it has already been determined that the liquid is not present by performing the liquid presence detection with the sensor. In addition, in a case where the count value after the sensor end becomes equal to or greater than the first predetermined value, and it is determined that the liquid is present by performing the liquid presence detection, it is considered that the liquid is refilled by the user after the sensor end flag is set. Therefore, in this case, as the control portion performs the reset processing, the count value returns to the initial value, even when the user does not perform the operation for performing the reset processing. In addition, when the liquid presence detection is performed by the sensor immediately after determining that the liquid is not present and setting the sensor end flag, in a case where there is an inclination in the liquid container (liquid consuming apparatus) or in a case where bubbles are generated in the liquid in the liquid container, there is a case where the determination of whether or not the liquid is present is changed, and the user becomes confused. Therefore, after determining that the liquid is not present, by performing the liquid presence detection after consuming the liquid to a certain extent (first predetermined value), it is possible to prevent the change in the determination.

Application Example 4

In the liquid consuming apparatus according to the application example, a user interface portion which includes a display portion that displays a message with respect to the user may be provided, the control portion may generate first data for displaying a first message to prompt the user to confirm the amount of the liquid remaining in the liquid container, and output the first data to the user interface portion, after performing the reset processing until performing the liquid presence detection and determining that the liquid is not present, and the user interface portion may display the first message on the display portion based on the first data output from the control portion.

In this configuration, after the control portion determines that the liquid is present at the predetermined height and the count value returns to the initial value until it is determined that the liquid is not present by the sensor, the first message which prompts the user to confirm the residual amount of the liquid is displayed on the user interface portion. Therefore, in a case where the deviation is generated between the count value and the actual consumption value of the liquid, it is possible to prompt the user to visually confirm the residual amount of the liquid. In addition, since the first message is not displayed when the liquid is consumed after the count value returns to the initial value and it is determined that the liquid is not present by the sensor, the user can confirm that a mechanism which detects the presence of the liquid by the sensor normally functions. In addition, in a case where malfunction is generated in the mechanism which detects the presence of the liquid for any reason, it is possible to bring the malfunction to the attention of the user by prompting the user to visually confirm the residual amount of liquid.

Application Example 5

In the liquid consuming apparatus according to the application example, the user interface portion may be capable of receiving the input of an instruction of refilling the liquid container with the liquid from the user, and the control portion may perform the reset processing in a case where it is determined that the liquid is present by performing the liquid presence detection after the user interface portion receives the input of the instruction of refilling the liquid.

In this configuration, the control portion performs the liquid presence detection when the user interface portion receives the input of the instruction of refilling the liquid, and performs the reset processing in a case where it is determined that the liquid is present. Therefore, when the user inputs the instruction of refilling the liquid container with the liquid from the user interface portion, and refills the liquid container with the liquid, it is possible for the user to always conveniently perform the reset processing.

Application Example 6

In the liquid consuming apparatus according to the application example, the user interface portion which includes the display portion that displays the message with respect to the user and is capable of receiving the input of the instruction of refilling the liquid container with the liquid from the user, and a sensor end flag which is set when the control portion performs the liquid present detection and determines that the liquid is not present, may be provided, and the control portion may stop the operation of consuming the liquid when the count value after the sensor end becomes equal to or greater than the total value of the first predetermined value and a second predetermined value in a case where the sensor end flag is set, the count value after the sensor end based on the consumption amount of the liquid computed from the time when it is lastly determined that the liquid is present before the sensor end flag is set becomes equal to or greater than the first predetermined value, and it is determined that the liquid is not present by performing the liquid presence detection, may perform the reset processing in a case where it is determined that the liquid is present by performing the liquid presence detection after the user interface portion receives the input of the instruction of refilling the liquid after stopping the operation of consuming the liquid, and may be capable of performing the operation of the consuming the liquid.

In this configuration, a case where the sensor end flag is set means that it has already been determined that the liquid is not present by performing the liquid presence detection with the sensor. In addition, a case where it is determined that the liquid is not present by performing the liquid presence detection after the count value after the sensor end becomes equal to or greater than the first predetermined value means that the liquid is not refilled by the user, even though the residual amount of the liquid is small. In this case, the operation of consuming the liquid is stopped when a difference value becomes equal to or greater than the total value of the first predetermined value and the second predetermined value. The operation of consuming the liquid is stopped when the difference value becomes equal to or greater than the total value if the total value of the first predetermined value and the second predetermined value is set to be a value which corresponds to an amount of the liquid which can be consumed before the blank driving is performed after determining that the liquid is not present by performing the liquid presence detection with the sensor. Therefore, it is possible to prevent the liquid in the liquid container from being used up, and the blank driving from being generated.

In addition, in this configuration, after stopping the operation of consuming the liquid, when the user inputs the instruction of refilling the liquid container with the liquid from the user interface portion and refills the liquid container with the liquid, and it is determined that the liquid is present by the liquid presence detection, it is possible to make the count value return to the initial value, and to perform the operation of consuming the liquid. In addition, since the count value returns to the initial value at the moment when the liquid container is refilled with the liquid, it is possible to correct the deviation between the count value and the actual consumption value.

Application Example 7

In the liquid consuming apparatus according to the application example, the control portion may generate second data for displaying a second message to prompt the user to refill the liquid container with the liquid, and output the second data to the user interface portion, when the count value after the sensor end becomes equal to or greater than the first predetermined value, and it is determined that the liquid is not present by performing the liquid presence detection, and the user interface portion may display the second message on the display portion based on the second data output from the control portion.

In this configuration, the second message, for prompting the user to refill the liquid container with the liquid, is displayed on the user interface portion, after it is determined that the liquid is not present by performing the liquid presence detection, until it is determined that the liquid is present by performing the liquid presence detection after the user refills the liquid container with the liquid. Therefore, the user can refill the liquid container with the liquid before the liquid in the liquid container is used up and before the blank driving is generated.

Application Example 8

In the liquid consuming apparatus according to the application example, the liquid for refilling the liquid container by the user may be accommodated in a refill container which is separated from the liquid consuming apparatus, and the volume of the liquid which can be accommodated in the liquid container may become equal to or greater than the volume of the refill container when the count value after the sensor end becomes equal to or greater than the first predetermined value.

In this configuration, since the liquid for the refill is accommodated in the separated refill container, it is possible to easily refill the liquid container with the liquid. In addition, when the count value after the sensor end becomes equal to or greater than the first predetermined value, the volume of the liquid which can be accommodated in the liquid container becomes equal to or greater than the volume of the refill container. Therefore, when the liquid container is refilled with the liquid at the time when the second message which prompts the user to refill the liquid container with the liquid is displayed, it is possible to accommodate the entire amount of the liquid accommodated in the refill container in the liquid container without causing the liquid to overflow.

Application Example 9

In the liquid consuming apparatus according to the application example, the control portion may perform the liquid presence detection and update the count value every time a predetermined amount of the liquid is consumed.

In this configuration, since the liquid presence detection is performed and the count value is updated every time the predetermined amount of liquid is consumed, it is possible to ascertain the residual amount of the liquid with high accuracy, and to reliably detect decreases in the residual amount of the liquid.

Application Example 10

In the liquid consuming apparatus according to the application example, a plurality of liquid containers which separately accommodate the plural types of liquid which are different from each other may be provided, the consumption amount calculation portion may calculate the consumption amount of each type of liquid for each liquid container, the storage portion may store the count value which is separately updated based on the consumption value of each type of liquid for each liquid container, the sensor may be disposed in each liquid container, and the control portion may perform the liquid presence detection before the count value returns to the initial value in each liquid container.

In this configuration, the consumption amount calculation portion calculates the consumption amount for each of the plural liquid containers in which the plural types of liquid which are different from each other are separately accommodated, the storage portion stores the count value, and the sensor is disposed in each liquid container and performs the liquid presence detection in each liquid container. Therefore, it is possible to separately manage the residual amount of the liquid in accordance with the type of the liquid or the volume of the liquid container, and to suppress the risk that the blank driving is generated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Invention

The invention is provided with a sensor for detecting whether or not the level of a residual amount of ink in an ink tank is equal to or greater than a first threshold value, and a control portion of a printer performs control which corresponds to a detection result (whether or not a residual amount level is equal to or greater than the first threshold value) by the sensor.

Here, "in accordance with a detection result of a senor" includes various aspects, such as in accordance with a combination of a plurality of detection results after performing the detection plural times by the sensor, not being limited to a meaning of in accordance with the detection result itself of the sensor.

In addition, the "first threshold value" can also include a case where the residual amount of the ink is zero, and can be set at an appropriate residual amount level position, regardless of the residual amount of the ink.

In addition, "control" has a wide sense including software processing inside the printer that cannot be confirmed by a user from the outside, not being limited to a control which can be practically visually confirmed by the user from the outside.

Summarizing the description above, hereinafter, an embodiment which specifies the invention will be described with reference to the drawings. The drawings to be used illustrate by appropriately enlarging, reducing, or exaggerating so that the parts described become recognizable. In addition, there is a case where elements other than configuration elements, which are necessary for the description, will be omitted from the drawings.

Common Configuration in Each Example

Hereinafter, first, a common configuration of each example will be described.

Basic Configuration of Printer System

Figure 1:
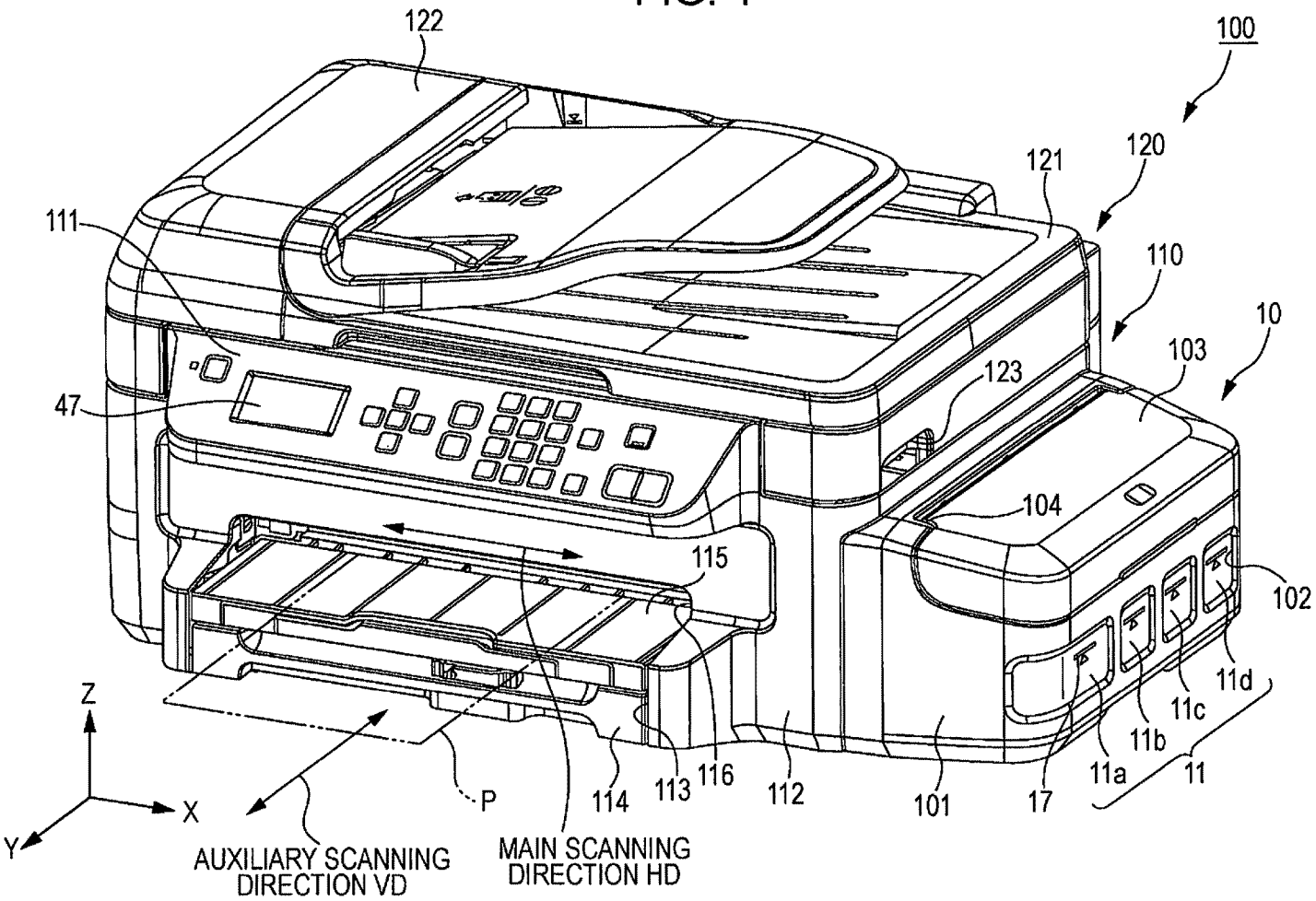
FIG. 1 is a perspective view illustrating a basic configuration of a printer system according to an embodiment.

A basic configuration of a printer system including an ink jet printer (hereinafter, simply referred to as a printer) which serves as a liquid consuming apparatus or a liquid discharging apparatus according to the embodiment will be described with reference to FIG. 1. FIG. 1 is a perspective view illustrating the basic configuration of the printer system according to the embodiment. A printer system 100 according to the embodiment is a multifunction machine which is provided with a printer 110 that serves as a liquid consuming apparatus, and a scanner 120.

In FIG. 1, a Y-axis, an X-axis which is orthogonal to the Y-axis, and a Z-axis which is orthogonal to the X-axis and the Y-axis, are illustrated. In each of the XYZ axes, an orientation of an arrow illustrates a + direction (normal direction), and an orientation reverse to the orientation of the arrow illustrates a − direction (negative direction). In a state of being used, the printer system 100 is disposed on a horizontal plane which is defined by the X-axis and the Y-axis, and a +Y direction is a front surface of the printer system 100. The Z-axis is an axis which is orthogonal to the horizontal plane, and a −Z direction is a perpendicular downward direction.

As illustrated in FIG. 1, the printer system 100 includes the printer 110, the scanner 120, and an ink supply portion 10. The printer system 100 includes an operation panel 111 which serves as a user interface portion, on a front surface side.

On the operation panel 111, a display portion 47 for displaying the number of buttons for performing operations, such as turning the power of the printer system 100 ON/OFF, printing by the printer 110, and reading a document by the scanner 120, an operation state of the printer system 100, or a message, is disposed. On the operation panel 111, a reset button or the like for the user to refill the ink tank 11 with the ink and perform reset processing, is also disposed. The reset processing will be described later.

The printer 110 can eject the ink as the liquid, and can perform the printing on a printing medium P, such as a paper sheet. The printer 110 includes a case portion 112. The case portion 112 configures an outer shell of the printer 110. On a front surface side of the case portion 112, an opening portion 113 is provided. A paper cassette 114 is mounted to be attachable to and detachable from the case portion 112 in the opening portion 113. Above the paper cassette 114 (+Z direction), a paper delivery tray 115 is provided to be extendable and contractible in a forward-and-rearward direction (the +Y direction and the −Y direction).

Although described in detail later, the X-axis direction (the +X direction and the −X direction) is a main scanning direction HD of a printing head of the printer 110, and the Y-axis direction (the +Y direction and the −Y direction) is an auxiliary scanning direction VD of the printer 110. In the paper cassette 114, the plurality of printing mediums P are placed in a stacked state. The printing medium P placed in the paper cassette 114 are supplied one by one into the case portion 112 along the auxiliary scanning direction VD, are delivered from a paper delivery port 116 along the auxiliary scanning direction VD after the printing is performed by the printer 110, and are placed on the paper delivery tray 115.

The scanner 120 is placed on the printer 110. The scanner 120 includes a case portion 121. The case portion 121 configures an outer shell of the scanner 120. The scanner 120 is a flat head type, and includes a document table (not illustrated) which is formed of a transparent plate-shaped member, such as glass, and an imaging element (not illustrated), such as an image sensor. The scanner 120 can read an image or the like recorded on the medium, such as a paper sheet, as image data via the imaging element.

The scanner 120 includes an auto document feeder 122 in an upper end portion. By the auto document feeder 122, it is possible to consequently feed and read a plurality of stacked documents (the paper sheet on which the image or the like is recorded) while reversing the documents one by one. The scanner 120 is configured to be rotatable with respect to the printer 110, and also has a function as a lid of the printer 110. The user can rotate the scanner 120 with respect to the printer 110 by inserting a finger into a handgrip portion 123 and by lifting up the scanner 120. Accordingly, it is possible to open the scanner 120 with respect to the printer 110.

The ink supply portion 10 is disposed on a side of the printer 110 in the +X-axis direction. The ink supply portion 10 has a function of supplying ink IK (refer to FIG. 4B) as liquid to the printer 110. The ink supply portion 10 includes a case portion 101. Ink tanks 11 which serve as a plurality of liquid containers are disposed in the case portion 101, and plural types of ink IK which are different from each other are separately accommodated in the plurality of ink tanks 11. In other words, in the plurality of ink tanks 11, different types of ink IK are accommodated in each ink tank 11.

In the embodiment, four ink tanks 11*a*, 11*b*, 11*c*, and 11*d* are provided. In addition, in the embodiment, as the type of ink, four types, such as black ink and color ink (yellow, magenta, and cyan), are employed. Black ink IKa is accommodated in the ink tank 11*a*, and each of color (yellow, magenta, and cyan) ink IKb, IKc, and IKd is accommodated in the ink tanks 11*b*, 11*c*, and 11*d* (refer to FIG. 4B).

The ink tanks 11*a*, 11*b*, 11*c*, and 11*d* are disposed to be aligned along the Y-axis direction from the front surface side of the printer 110, and are fixed to the inside of the case portion 101. In addition, hereinafter, in a case where four ink tanks 11*a*, 11*b*, 11*c*, and 11*d*, and four types of ink IKa, IKb, IKc, and IKd are not distinguished, the ink tank and the ink will be simply written as the ink tank 11 and the ink IK.

In the embodiment, with respect to each of four ink tanks 11, it is possible to pour the ink IK into the ink tank 11 from the outside of the printer system 100. Therefore, the user of the printer system 100 can pour the ink IK which is accommodated in a separated container into the ink tank 11, and can refill the ink tank 11 with the ink IK. In addition, a detailed configuration of the ink tank 11 will be described later.

In the case portion 101, a window portion 102 is provided corresponding to each of four ink tanks 11. The window portion 102 has light transmitting properties. Therefore, the user can visually confirm four ink tanks 11 via the window portion 102. The window portion 102 may be provided as an opening portion formed in the case portion 101, and may be configured of a member having light transmitting properties.

At least a part of a part which faces the window portions 102 of each ink tank 11 has light transmitting properties. Therefore, the user can visually confirm an amount of the ink IK in the four ink tanks 11 via the window portion 102. In each ink tank 11, an upper limit mark 17 is provided at a part which faces the window portion 102. The upper limit mark 17 illustrates an upper limit when refilling the ink IK as a reference so that the ink does not overflow from the ink tank 11 when the user pours the ink IK. In addition, the user can ascertain the amount of the ink IK in each ink tank 11 by using the upper limit mark 17 as a reference.

In the embodiment, the volume of the ink tank 11*a* is greater than the volumes of the ink tanks 11*b*, 11*c*, and 11*d*. The volumes of the ink tanks 11*b*, 11*c*, and 11*d* are the same as each other. In the printer 110, it is assumed that the black ink IKa is consumed more than the color ink IKb, IKc, and IKd. Therefore, among four ink tanks 11, the volume of the ink tank 11*a* in which the black ink IKa is accommodated is greater than the volumes of the ink tanks 11*b*, 11*c*, and 11*d* in which the color ink IKb, IKc, and IKd are accommodated. In addition, the ink tank 11*a* in which the black ink IKa is accommodated is disposed on the front surface side of the printer 110 so that the user easily ascertains the residual amount.

In addition, an order of disposition from the front surface side of the ink tanks 11*b*, 11*c*, and 11*d* in which the color ink IKb, IKc, and IKd are accommodated, is not particularly limited. In addition, in a case where not the black ink IKa, but any one of the ink IKb, IKc, and IKd is consumed more, the corresponding ink IK may be accommodated in the ink tank 11*a* having a large volume.

A lid portion 103 is provided in an upper portion of the case portion 101. The lid portion 103 is engaged with the case portion 101 to be rotatable via a hinge portion 104. When the lid portion 103 is opened, four ink tanks 11 are exposed. For example, when the user pours the ink IK into the ink tank 11, by rotating the lid portion 103 and opening the lid portion 103 upward, it is possible to access the ink tank 11.

Configuration of Ink Supply Portion

Figure 3:
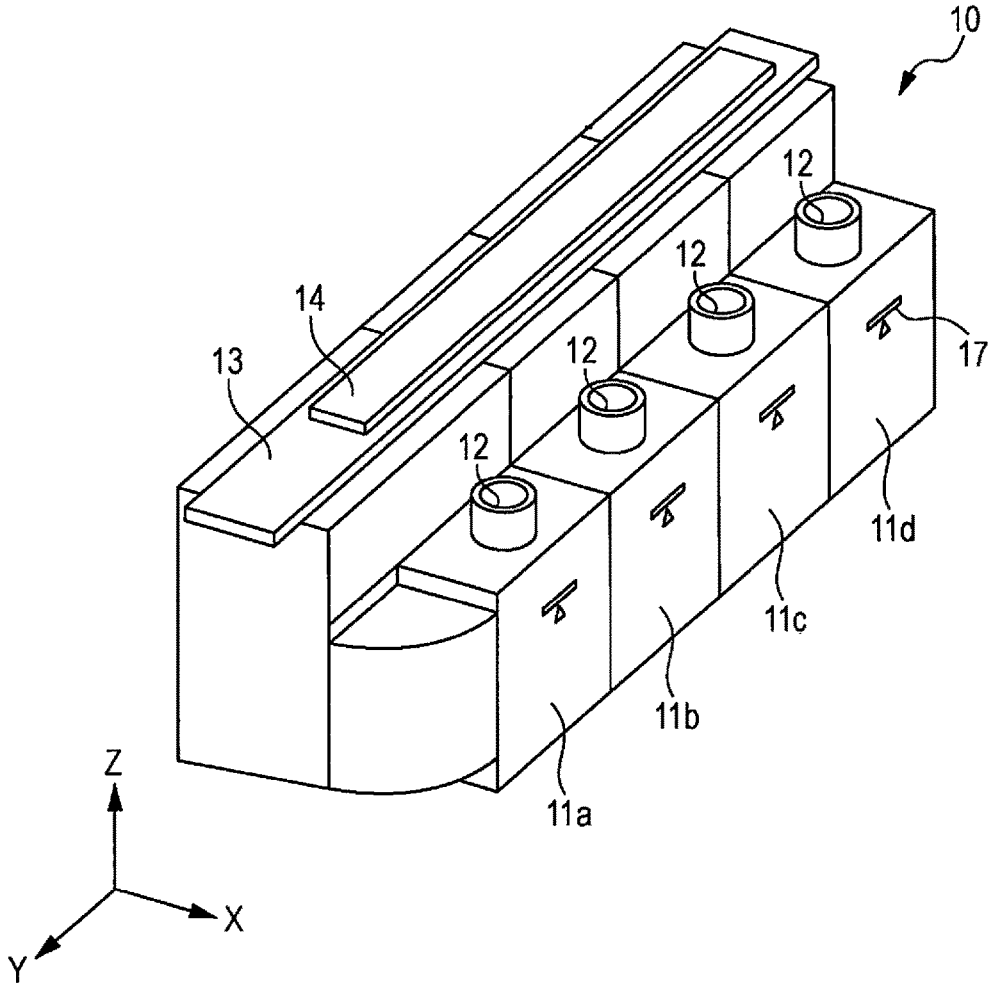
FIG. 3 is a schematic configuration view of an ink supply portion according to the embodiment.
Figure 4A:
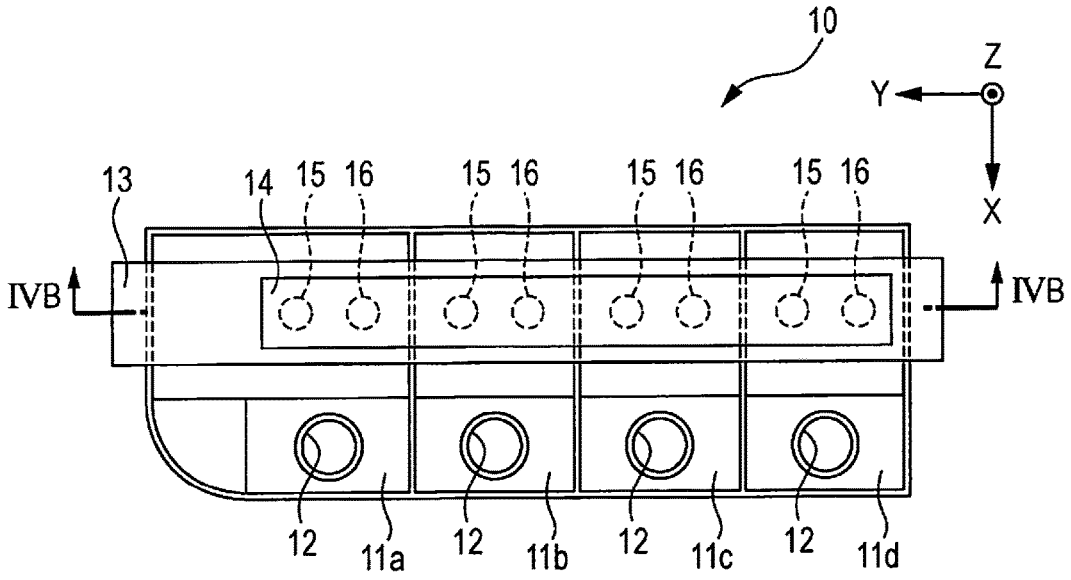
FIGS. 4A and 4B are schematic configuration views of the ink supply portion according to the embodiment.
Figure 4B:
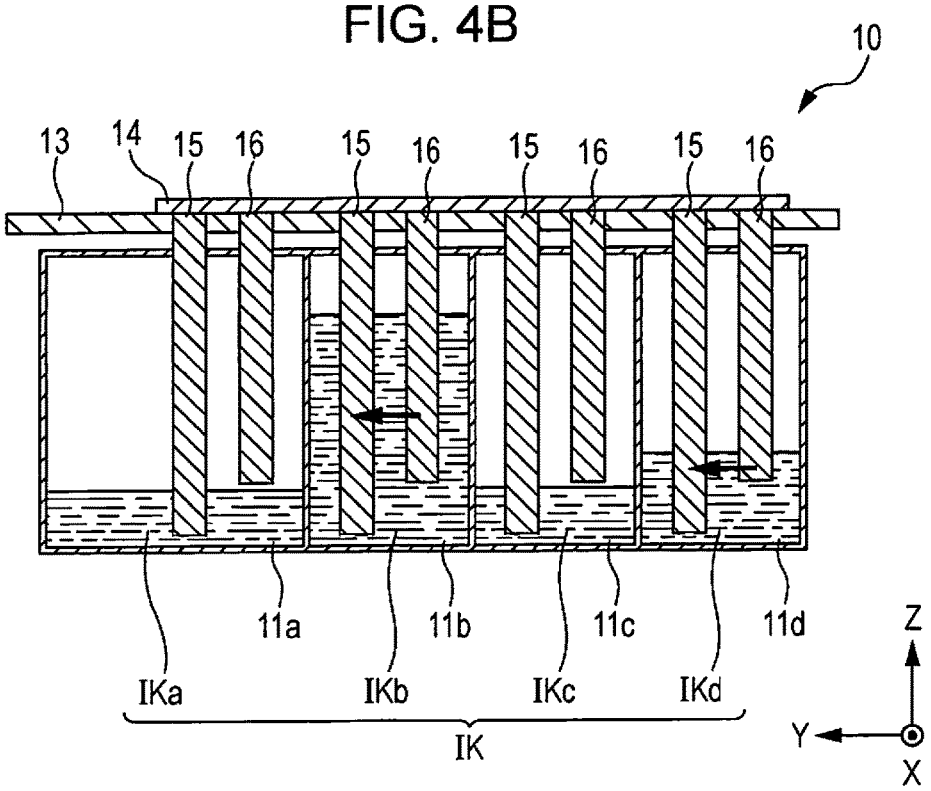

Next, a configuration of the ink supply portion according to the embodiment will be further described with reference to FIGS. 3 to 4B. FIGS. 3 to 4B are schematic configuration views of the ink supply portion according to the embodiment. Specifically, FIG. 3 is a perspective view of the ink supply portion, FIG. 4A is a plan view of the ink supply portion, and FIG. 4B is a sectional view along line IVA-IVA' of FIG. 4A. In addition, In FIG. 3 and FIGS. 4A and 4B, a state where the case portion 101 is removed from the ink supply portion 10 illustrated in FIG. 1 is illustrated.

As illustrated in FIG. 3 and FIGS. 4A and 4B, the ink supply portion 10 includes four ink tanks 11*a*, 11*b*, 11*c*, and 11*d*, a holding portion 13, a detection substrate 14, and one pair of electrodes 15 and 16 which function as sensors.

As illustrated in FIG. 3, the ink tanks 11*a*, 11*b*, 11*c*, and 11*d* are disposed to be aligned in one row along the Y-axis direction. The ink tank 11 is formed of a synthetic resin, such as nylon or polypropylene. Four ink tanks 11 may be configured to be separated from each other, or may be integrally configured. In a case where the ink tank 11 is integrally configured, the ink tank 11 may be integrally formed, or four ink tanks 11 which are separately formed may be linked to be integrally bound.

In the embodiment, an upper surface of a part on a front side (+X direction) of the ink tank 11 is lower than an upper surface of a part on a rear side (−X direction). In addition, on the upper surface of the part on the front side of the ink tank 11, a pouring port 12 for pouring the ink IK from the outside is provided. As the user pours the ink IK from the pouring port 12, it is possible to refill the ink tank 11 with each color of ink IK. Although not illustrated, the ink IK for refilling the ink tank 11 by the user is accommodated and provided in a separated refill container (hereinafter, referred to as a refill bottle).

In the ink tank 11, the Z-axis direction, the Y-axis direction, and the X-axis direction are respectively referred to as a height orientation, a width orientation, and a depth orientation. As described above, the volume of the ink tank 11*a* in which the black ink IKa is accommodated is greater than the volumes of the ink tanks 11*b*, 11*c*, and 11*d* in which the color ink Ikb, IKc, and IKd are accommodated. When comparing the ink tank 11*a* with the ink tanks 11*b*, 11*c*, and 11*d*, the height and the depth are the same as each other, and the width is different. In other words, the width (the length in the Y-axis direction) of the ink tank 11*a* is greater than the widths of the ink tanks 11*b*, 11*c*, and 11*d*.

In addition, the volume (refer to FIG. 5) of the refill bottle in which the ink IK for the refill by the user is accommodated, varies according to the type of the ink IK. In other words, the volume of the refill bottle varies corresponding to the volume of the ink tank 11 in which each ink IK is accommodated. In the embodiment, since the volumes of ink tanks 11*b*, 11*c*, and 11*d* in which the color ink IKb, IKc, and IKd are accommodated are the same as each other, the volumes of the refill bottles in which the refill color ink IKb, IKc, and Ikd are accommodated are also the same as each other. Meanwhile, since the volume of the ink tank 11*a* in which the black ink IKa is accommodated is greater than the volumes of the ink tanks 11*b*, 11*c*, and 11*d*, and the volume of the refill bottle in which the refill black ink IKa is accommodated is greater than the volumes of the refill bottles in which the refill color ink IKb, IKc, and IKd are accommodated.

Above the part on the rear side of the ink tank 11, the holding portion 13 in which the ink tanks 11*a*, 11*b*, 11*c*, and 11*d* are aligned and extend in the Y-axis direction, is disposed. The holding portion 13 is fixed to four ink tanks 11 by a screw or the like. The holding portion 13 has a function of holding the detection substrate 14 disposed at an upper part thereof. The holding portion 13 is formed of, for example, a synthetic resin having insulating properties. On the holding portion 13, the detection substrate 14 in which the ink tanks 11*a*, 11*b*, 11*c*, and 11*d* are aligned and extend along the Y-axis direction, is disposed. The detection substrate 14 is held by the holding portion 13.

As illustrated in FIGS. 4A and 4B, one pair of electrodes 15 and 16 which serve as the sensors for performing ink presence detection are electrically connected to the detection substrate 14, corresponding to each ink tank 11. One pair of electrodes 15 and 16 is connected to the detection substrate 14, for example, via a spring-like connector. A total of four pairs of electrodes 15 and 16 which correspond to four ink tanks 11 are disposed to be aligned along an extending direction of the detection substrate 14. The detection substrate 14 is connected to a control portion 40 by a flexible flat cable (FFC) which is not illustrated. Accordingly, the output of the sensor is input to a liquid surface lowering determination portion 43 of the control portion 40.

As illustrated in FIG. 4B, one pair of electrodes 15 and 16 are disposed inside each ink tank 11. One pair of electrodes 15 and 16 have a longitudinal direction, and are disposed so that the longitudinal direction is along the height direction (Z-axis direction) of the ink tank 11 downward (−Z direction) from the detection substrate 14. One pair of electrodes 15 and 16 is configured of a metal material, such as a stainless steel.

One electrode 15 among one pair of electrodes has a length in which a tip end portion on a lower side is drawn to a position near a bottom portion of the ink tank 11. The other electrode 16 among one pair of electrodes is shorter than the electrode 15, and has a length in which the tip end portion on the lower side is drawn to a position of a predetermined height from the bottom portion of the ink tank 11. The predetermined height from the bottom portion where the tip end portion of the electrode 16 is positioned is set to be the same height with respect to four ink tanks 11. The predetermined height is appropriately set based on the volumes of the ink tanks 11*a*, 11*b*, 11*c*, and 11*d*, or the consumption amount of each ink IK during a predetermined period.

One pair of electrodes 15 and 16 has a function of detecting whether or not the ink IK is present at the predetermined height in each ink tank 11. When performing the ink presence detection, a voltage is applied to between one pair of electrodes 15 and 16 via the detection substrate 14 from the control portion 40 (refer to FIG. 2). It is preferable that the voltage applied to between one pair of electrodes 15 and 16 is an AC voltage from the viewpoint of suppressing deposits of the ink IK.

On the detection substrate 14, an analog switch (not illustrated) which switches the ink tank 11 to which the voltage is applied, is provided. When the liquid surface lowering determination portion 43 (refer to FIG. 2) provided in the control portion 40 (FIG. 2) performs the ink presence detection, the ink tank 11 which is a target to be determined is selected by switching the analog switch. Then, the voltage is applied to between one pair of electrodes 15 and 16 with respect to the selected ink tank 11.

Furthermore, the liquid surface lowering determination portion 43 (FIG. 2) provided in the control portion 40 (FIG. 2) will be described in detail later.

When focusing on the ink tank 11*b* in FIG. 4B, the height of a liquid surface of the ink IKb accommodated in the ink tank 11*b* is equal to or greater than the predetermined height. In other words, in the ink tank 11*b*, the ink IKb infiltrates into both of the one pair of the electrodes 15 and 16. Therefore, when performing the ink presence detection with respect to the ink tank 11*b*, a current which corresponds to resistance between one pair of electrodes 15 and 16 flows due to the applied voltage. Then, a signal based on a resistance value between one pair of electrodes 15 and 16 disposed in the ink tank 11*b* is output to the control portion 40 via a detection circuit provided on the detection substrate 14. In a case where the ink IK is not present, the resistance value between one pair of electrodes 15 and 16 becomes undefined, and in a case where the ink IK is present, the resistance value corresponds to the ink IK.

As a result, the liquid surface lowering determination portion 43 (FIG. 2) determines that the ink IKb is present at the predetermined height with respect to the ink tank 11*b*. Similarly, in the ink tank 11*d* in which the height of the liquid surface of the accommodated ink IKd is equal to or greater than the predetermined height, the current flows through the ink IKd between one pair of electrodes 15 and 16 due to the applied voltage when performing the ink presence detection. Therefore, the liquid surface lowering determination portion 43 (FIG. 2) determines that the ink IKd is present at the predetermined height.

Meanwhile, when focusing on the ink tank 11*a*, the height of the liquid surface of the ink IKa accommodated in the ink tank 11*a* is lower than the predetermined height. In other words, in the ink tank 11*a*, the ink IKa does not infiltrate into the electrode 16. Therefore, when performing the ink presence detection with respect to the ink tank 11*a*, the current does not flow between one pair of electrodes 15 and 16, even when the voltage is applied.

As a result, the liquid surface lowering determination portion 43 (FIG. 2) determines a "sensor end" in which the ink IKa is not present at the predetermined height with respect to the ink tank 11*a*. Similarly, with respect to the ink tank 11*c* in which the height of the liquid surface of the accommodated ink IKc is lower than the predetermined height, the current does not flow between one pair of electrodes 15 and 16, even when the voltage is applied when performing the ink presence detection. Therefore, the liquid surface lowering determination portion 43 (FIG. 2) also determines the "sensor end" in which the ink IKc is not present at the predetermined height.

Furthermore, the determination of the "sensor end" will be further described later.

In this manner, in the embodiment, based on the presence (difference in the resistance value) of conduction between one pair of electrodes 15 and 16, it is possible to detect whether or not the ink IK is present at the predetermined height from the bottom portion in the ink tank 11. The liquid surface lowering determination portion 43 (FIG. 2) repeatedly performs the determination of whether or not the ink IK is present at the predetermined height from the bottom portion in each ink tank 11 at the above-described predetermined timing.

When the ink IK is consumed by repeating the printing by the printer 110, and the liquid surface lowering determination portion 43 performs the determination, if the liquid surface of the ink IK in any of the ink tanks 11 becomes lower than the predetermined height, the ink tank 11 determines the "sensor end" in which the ink is not present at the predetermined height.

When the ink IK is consumed and the liquid surface is further lowered after the liquid surface lowering determination portion 43 (FIG. 2) determines the "sensor end" in which the ink IK is not present at the predetermined height, and the ink IK sent to a printing head 22 (refer to FIG. 2) from the ink tank 11 is used up, a blank driving state appears. In the embodiment, in order to prevent the blank driving state, residual amount management of the ink IK in the ink tank 11 is performed as will be described hereinafter.

Another Configuration of Printer

Figure 2:
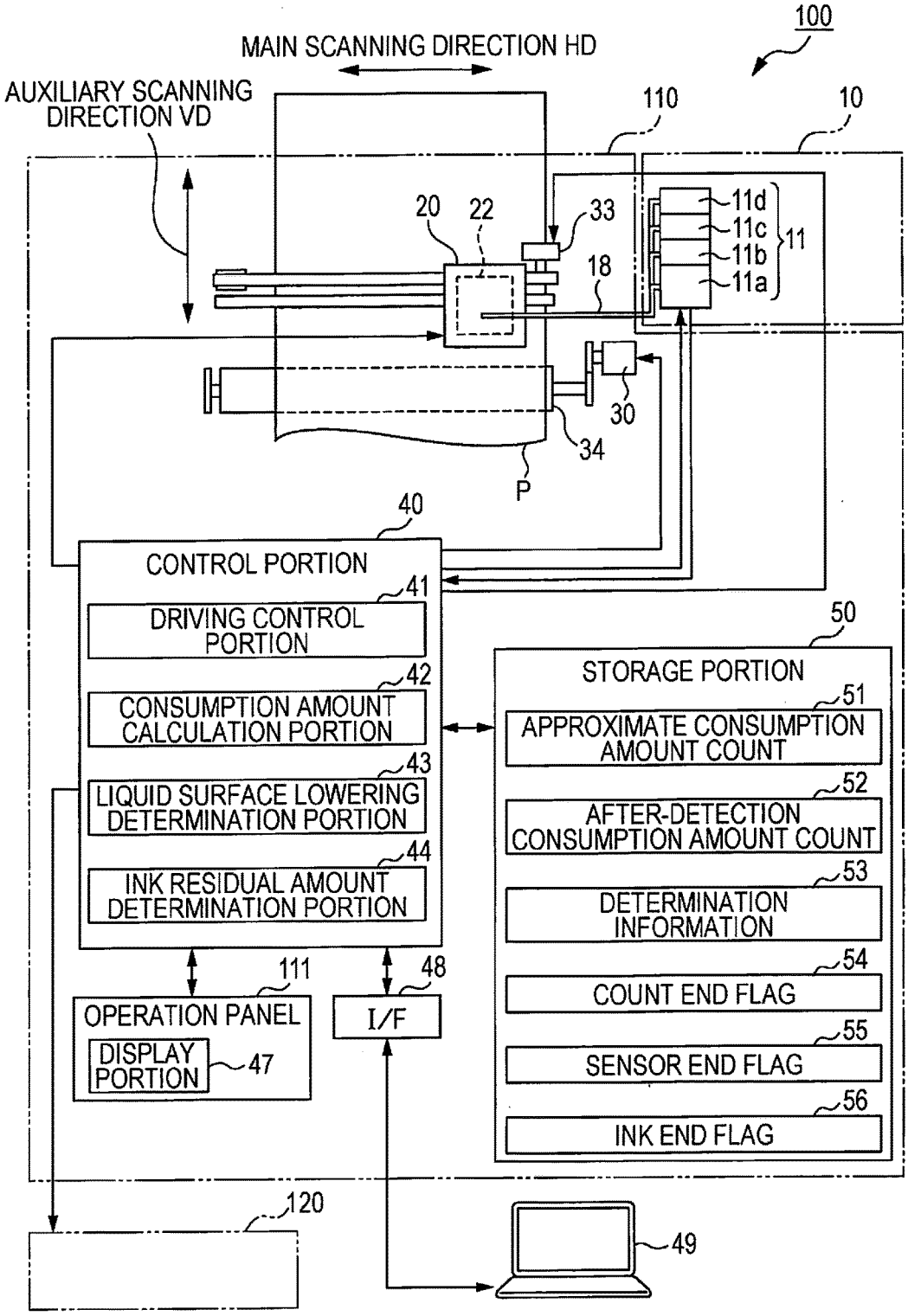
FIG. 2 is a schematic configuration view of a printer according to the embodiment.

Next, another configuration of the printer according to the embodiment will be described with reference to FIG. 2. FIG. 2 is a schematic configuration view of the printer according to the embodiment. As illustrated in FIG. 2, the printer 110 according to the embodiment includes a carriage 20, a paper sending motor 30, a carriage motor 33, a paper sending roller 34, the control portion 40, and a storage portion 50. In addition, the scanner 120 is omitted in FIG. 2.

The printing head 22 is loaded in the carriage 20. The printing head 22 has a plurality of nozzles which eject the ink IK to a lower surface side (−Z-axis direction side) of the carriage 20. Between the printing head 22 and each ink tank 11, a tube 18 is provided. Each ink IK in the ink tank 11 is sent to the printing head 22 via the tube 18. The printing head 22 ejects each ink IK sent from the ink tank 11 as ink droplets onto the printing medium P from the plurality of nozzles.

The carriage 20 is connected to the control portion 40 by a cable (not illustrated). The carriage 20 reciprocates along the main scanning direction HD on the printing medium P by driving the carriage motor 33. The paper sending motor 30 drives the paper sending roller 34 to rotate, and transports the printing medium P in the auxiliary scanning direction VD. The ejection control of the printing head 22 is performed by the control portion 40 via the cable.

In other words, in the printer 110, as the control portion 40 controls the paper sending motor 30, the carriage motor 33, and the printing head 22, while the carriage 20 moves along the main scanning direction HD, the ink IK is ejected from the plurality of nozzles of the printing head 22 onto the printing medium P transported in the auxiliary scanning direction VD. Accordingly, the printing on the printing medium P is performed.

One end portion of the main scanning direction HD in a moving region of the carriage 20 is a home position region where the carriage 20 stands by. In the home position region, a cap (not illustrated) for performing maintenance, such as cleaning of the nozzles of the printing head 22, is disposed. FIG. 2 illustrates a state where the carriage 20 is positioned at the home position.

In addition, in the other end portion (end portion on a side opposite to the home position) of the main scanning direction HD in the moving region of the carriage 20, a waste ink box (not illustrated) or the like for accepting waste ink when performing the flushing or cleaning of the printing head is disposed. In addition, the flushing means ejecting the ink IK regardless of the printing from each nozzle of the printing head 22 during the printing of the printing medium P. The cleaning means cleaning the inside of the printing head by suctioning the printing head by a pump or the like which is provided in the waste ink box without driving the printing head.

The operation panel 111 which includes the display portion 47 is connected to the control portion 40 as the user interface portion. As the user operates the operation panel 111, it is possible to operate the printer 110 and the scanner 120 by the control portion 40.

For example, in FIG. 1, after setting the document to the auto document feeder 122 of the scanner 120, the user operates the operation panel 111 and starts the operation of the printer system 100. Then, the document is read by the scanner 120. Next, based on the image data of the read document, the printing medium P is supplied to the inside of the printer 110 (case portion 112) from the paper cassette 114, and the printing is performed by the printer 110 on the printing medium P.

As illustrated in FIG. 2, it is possible to connect a computer 49 to the control portion 40 via an interface (I/F) 48. The control portion 40 receives the image data from the computer 49 via the interface 48, and controls the printing of the image on the printing medium P by the printer 110 (printing head 22). In addition, the control portion 40 performs the control of reading the document by the scanner 120, sending the image data to the computer 49 via the interface 48, or printing the read image.

The control portion 40 includes a driving control portion 41, a consumption amount calculation portion 42, the liquid surface lowering determination portion 43, and an ink residual amount determination portion 44. The control portion 40 includes a CPU, a ROM, a RAM, or the like (not illustrated). The control portion 40 develops a control program stored in the ROM in the RAM, the CPU executes the control program developed in the RAM, and accordingly, each portion of the control portion 40 is operated. Otherwise, instead of providing the CPU, the control portion 40 may be configured of hardware, such as an application specific IC (ASIC) which expresses the same function as a function of performing the CPU and the control program, and may be configured of both the CPU and the ASIC.

The driving control portion 41 controls the carriage motor 33, and performs control of moving the carriage 20. Accordingly, the carriage motor 33 drives the printing head 22 provided in the carriage 20 to be moved.

First Example

Next, a first example of the invention will be described. The example is an example related to the ink residual amount management.

Configuration of Control Portion

Hereinafter, first, the consumption amount calculation portion 42, the liquid surface lowering determination portion 43, and the ink residual amount determination portion 44 which are provided in the control portion 40, will be described with reference to FIG. 2.

The consumption amount calculation portion 42 calculates the ink consumption amount which is consumed by ejecting the ink IK from each nozzle of the printing head 22. The consumption amount calculation portion 42 starts calculation of the ink consumption amount by using a state where each ink tank 11 is filled with the ink IK as a standard (initial value). More specifically, when the user refills the ink tank 11 with the ink IK and presses the reset button, with respect to the ink tank 11, the count value of the ink consumption amount is initialized (return to an initial value, in the example, the count value illustrating 0 g of the ink consumption amount), and the calculation of the ink consumption amount is started. In addition, with respect to the ink tank 11, integration of the ink consumption amount is continuously performed until a count end which will be described later is achieved and the user presses the reset button again.

Figure 5:
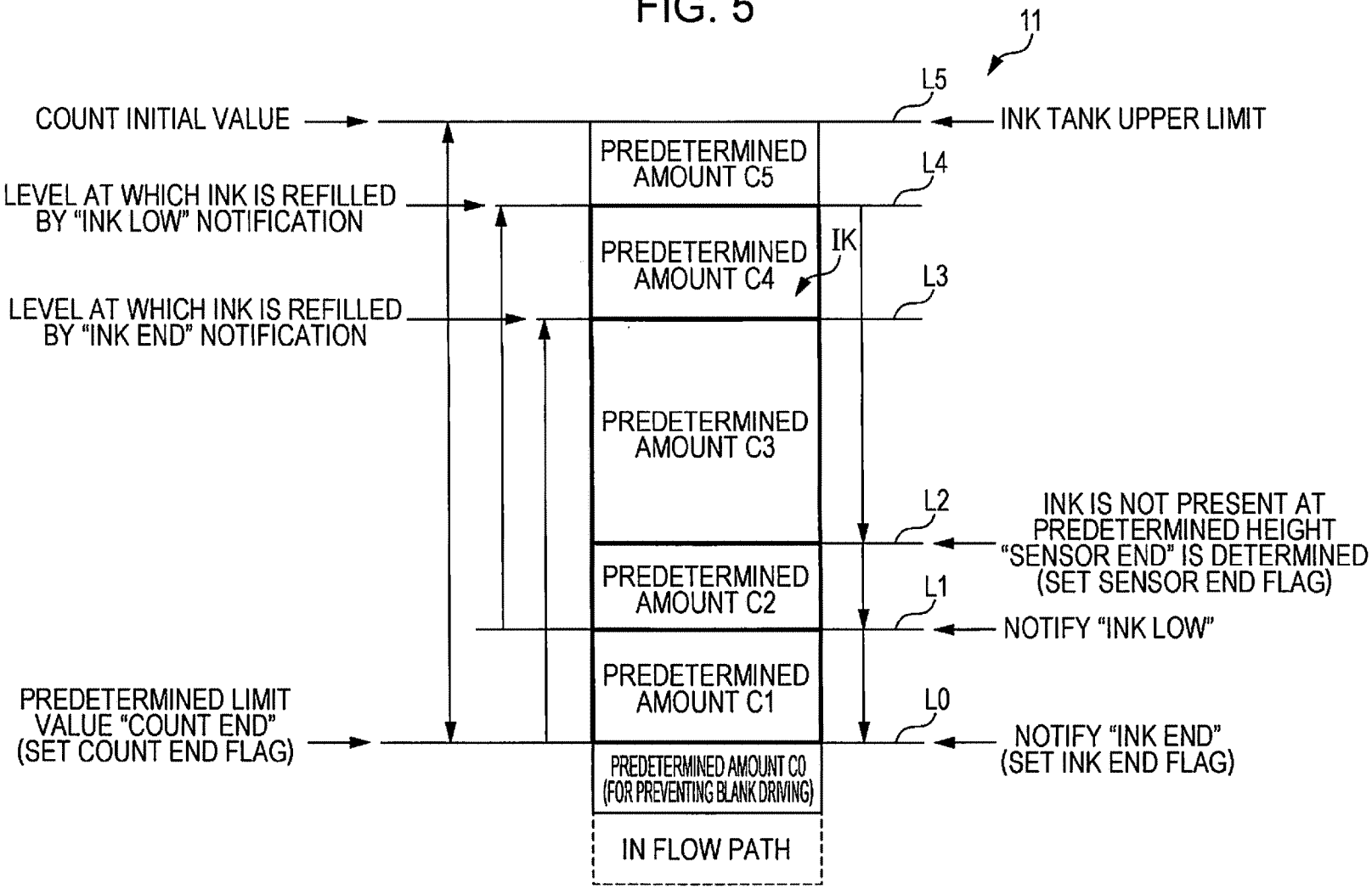
FIG. 5 is a view schematically illustrating ink residual amount management in an ink tank according to the embodiment.

In the printer 110 according to the embodiment, when displaying the ink residual amount on a monitor of the computer 49, an ink weight for one refill bottle provided by a printer vender is calculated as an amount of the ink IK consumed by the printer 110. In other words, the amount is displayed as the weight for one refill bottle (ratio of an ink consumption weight of an approximate ink consumption amount count value, with respect to the ink amount (=an ink amount which corresponds to the total of a predetermined amount C2, a predetermined amount C3, and a predetermined amount C4) that corresponds to the total of a predetermined amount C1, the predetermined amount C2, and the predetermined amount C3 which is illustrated in FIG. 5 and will be described later).

The ink consumption amount calculated by the consumption amount calculation portion 42 includes the ink consumption amount which is used in the maintenance of the printing head 22 by the cleaning or flushing of the nozzles of the printing head 22, in addition to the ink consumption amount by the printing on the printing medium P. The ink consumption amount is a count value by a so-called dot count method. In other words, based on the image data to be printed, by integrating the ink consumption amount which is consumed for one dot according to a design, and the number of dots which are required in the image data to be printed, the integrated ink consumption amount is calculated. In the example, for one pass in which the carriage 20 scans one time, the amount of each ink IK (an amount of the ink IK per one dot×the number of ejected dots) ejected from the nozzles of the printing head 22 is calculated.

In addition, each of the ink consumption amounts when performing the cleaning or the flushing is calculated as the amount of the ink IK which is used every time the cleaning or the flushing is performed one time. The count value of the ink consumption amount is stored in the storage portion 50 as an approximate consumption amount count 51, every time the predetermined amount (unit consumption amount) of the ink IK is consumed during the printing, or every time the paper is delivered. In addition, when performing the cleaning or the flushing, to the extent thereof, the value is stored as the approximate consumption amount count 51.

A state where the count value of the ink consumption amount reaches a predetermined limit value is called a "count end". Although described in detail later, the predetermined limit value is a count value of the ink consumption amount which corresponds to the maximum consumable volume of the ink tank 11. When the count value of the ink consumption amount reaches the predetermined limit value, the control portion 40 sets a count end flag 54 in the storage portion 50.

Although not illustrated, in the printer 110, for example, when the user performs the operation of performing the printing, based on the count value of the ink consumption amount, the reference of the residual amount of the ink IK in each ink tank 11 can be displayed on the monitor (screen) of the computer 49. Therefore, the user can not only visually confirm the residual amount of the ink IK in each ink tank 11 via the window portion 102 of the ink tank 11, but also ascertain the residual amount by using the reference by the monitor of the computer 49.

In addition, by outputting the reference of the ink residual amount of the ink tank 11 based on the count value by wired or wireless communication to an external terminal other than the computer 49 or the printer system 100, and by displaying the reference of the ink residual amount on the monitor of the computer 49 or the external terminal, a remote user can recognize the residual amount. In addition, in addition to the description above, the reference of the ink residual amount of the ink tank 11 based on the count value may be configured to be displayed on the display portion 47 of the operation panel 111 of the printer 110.

The liquid surface lowering determination portion 43 performs the ink presence detection of whether or not the ink IK is present at the predetermined position in the ink tank 11, that is, at the predetermined height from the bottom portion, with respect to each of the ink tanks 11. In the ink tank 11, one pair of electrodes 15 and 16 which serve as sensors which will be described later are disposed in each ink tank 11 (refer to FIG. 4B). In the ink presence detection, the liquid surface lowering determination portion 43 applies the voltage to one pair of electrodes 15 and 16, and determines whether or not the ink IK is present at the predetermined height in each ink tank 11 based on an output signal.

A state where the ink IK is not present at the predetermined height in the ink tank 11 based on the output signal from one pair of electrodes 15 and 16 as a result of the ink presence detection performed by the liquid surface lowering determination portion 43, is called the "sensor end". The control portion 40 sets a sensor end flag 55 in the storage portion 50 with respect to the ink tank 11 which is determined as the sensor end.

When the sensor end flag 55 is set, the consumption amount calculation portion 42 starts calculation of the ink consumption amount after the sensor end with respect to the ink tank 11 determined as the sensor end. The count value of the ink consumption amount after the sensor end is updated every time a predetermined amount (unit consumption amount) of ink IK is consumed, and is stored in the storage portion 50 as an after-detection consumption amount count 52.

The count value of the ink consumption amount after the sensor end is computed from an approximate consumption amount count value when the liquid surface lowering determination portion 43 lastly determines that the ink IK is present at the predetermined height before determining the sensor end. Therefore, it is possible to reduce the risk that the actual consumption amount of the ink IK consumed after the sensor end becomes greater than the count value stored as the after-detection consumption amount count 52. Accordingly, it is possible to suppress the risk that the blank driving is generated before the ink residual amount determination portion 44 determines the ink end based on the count value of the ink consumption amount after the sensor end.

In addition, instead of calculating the ink consumption amount after the sensor end, the count value when it is lastly determined that the ink IK is present at the predetermined height before determining the sensor end may be stored as a during-detection consumption amount count, and the difference value between the during-detection consumption amount count and the approximate consumption amount count 51 may be used as the ink consumption amount after the sensor end.

The ink presence detection by the liquid surface lowering determination portion 43 is repeatedly performed at the predetermined timing, such as before performing the reset processing which will be described later, when the power of the printer 110 (printer system 100) is turned ON when a printing job is received. In addition, the ink presence detection is performed every time the unit consumption amount of the ink IK is consumed during the printing.

However, the liquid surface lowering determination portion 43 does not perform the ink presence detection until the count value of the ink consumption amount after the sensor end becomes equal to or greater than a predetermined value A which will be described later, with respect to the ink tank 11 which is determined as the sensor end and in which the sensor end flag 55 is set. This is because there is a case where it is determined that the ink IK is present at the predetermined height by the following ink presence detection, after it is determined that the ink IK is not present at the predetermined height as the liquid surface changes, for example, due to the inclination of the printer 110 (printer system 100), or as bubbles are generated in the ink IK, and such a case makes the user confused.

The ink residual amount determination portion 44 determines the residual state of the ink IK in each ink tank 11 based on the count value of the ink consumption amount after the sensor end stored in the after-detection consumption amount count 52 and the determination information set in each ink tank 11.

Examples of the determination of the residual state of the ink IK include an "ink low" which indicates a state where the amount of the ink IK in the ink tank 11 is nearly used up, and an "ink end" which indicates a state where a consumable amount of the ink IK in the ink tank 11 is used up. The determination of the residual state of the ink IK is performed based on determination information 53 which is stored in the storage portion 50. The determination information 53 includes a predetermined value A which serves as a first predetermined value for determining the ink low, and a predetermined value B which serves as a second predetermined value for determining the ink end, as predetermined values set for each ink tank 11.

After the liquid surface lowering determination portion 43 determines the sensor end with respect to any of the ink tank 11, the ink residual amount determination portion 44 determines the ink low when the count value of the ink consumption amount after the sensor end of the ink tank 11 becomes equal to or greater than the predetermined value A.

With respect to the ink tank 11 which is determined as the ink low, the control portion 40 generates data (second data) for displaying an "ink low notification" (second message) which informs the user the decrease in the residual amount of the ink IK and prompts the user to refill the ink tank 11 with the ink IK, and outputs the data to the display portion 47. The display portion 47 displays the ink low notification based on the data. The message which prompts the user to refill the ink tank 11 with the ink IK is continuously displayed on the display portion 47 until an ink end flag 56 which will be described later is set, and until the count value returns to the initial value by performing the reset processing.

The ink residual amount determination portion 44 determines the ink end when the count value of the ink consumption value of the ink tank 11 after the ink low is determined becomes equal to or greater than the predetermined value B, that is, when the count value of the ink consumption amount after the sensor end becomes equal to or greater than the total value of the predetermined value A and the predetermined value B. The control portion 40 sets the ink end flag 56 in the storage portion 50 with respect to the ink tank 11 which is determined as the ink end.

When the ink end flag 56 is set, in order to prevent the blank driving state where the ink IK to be ejected is used up, the control portion 40 stops the printing operation of the printer 110. In addition, with respect to the ink tank 11 which is determined as the ink end, the control portion 40 generates data for displaying the "ink end notification" which informs the user that the ink IK is used up and which prompts the user to refill the ink tank 11 with the ink IK, and outputs the data to the display portion 47, and the display portion 47 displays the ink end notification based on the data.

When the ink end flag 56 is set and the printing operation is stopped, the reset processing is performed as the user presses the reset button, and the printer 110 does not operate until the liquid surface lowering determination portion 43 determines that the ink IK is present. After the ink end flag 56 is set and the printing operation is stopped, the user refills the ink tank 11 which is determined as the ink end with the ink IK, and presses the rest button, and when the control portion 40 receives the input of the instruction of refilling the ink IK via the operation panel 111, the ink presence detection is performed by the liquid surface lowering determination portion 43. In addition, when it is determined that the ink IK is present at the predetermined height, the reset processing is performed, and the printer 110 becomes capable of performing the printing operation.

The storage portion 50 stores information which can be rewritten in a non-volatile manner. The storage portion 50 is configured of a non-volatile memory, such as an EEPROM. The ROM provided in the control portion 40 may also be configured to have a function of the storage portion 50. The storage portion 50 has a region where the approximate consumption amount count 51, the after-detection consumption amount count 52, and the determination information 53 are stored. In addition, the storage portion 50 has a region where the count end flag 54, the sensor end flag 55, and the ink end flag 56 are set.

As described above, the count value of the approximate consumption amount count 51 is appropriately updated based on the ink consumption amount calculated by the consumption amount calculation portion 42 with respect to each ink tank 11. When the reset processing is performed as the user refills the ink tank 11 with the ink IK and presses the reset button, the approximate consumption amount count 51 stored with respect to the ink tank 11 is cleared and returns to the initial value. The reset processing is a processing of making the count value of the approximate consumption amount count 51 return to the initial value.

The after-detection consumption amount count 52 is appropriately updated based on the calculation of the ink consumption amount by the consumption amount calculation portion 42, with respect to the ink tank 11 determined as the sensor end. As the user refills the ink tank 11 with the ink IK and presses the reset button, the reset processing is performed, and when the liquid surface lowering determination portion 43 determines that the ink IK is present, the after-detection consumption amount count 52 stored with respect to the ink tank 11 is cleared and returns to the initial value.

The determination information 53 is information for determining the ink low and the ink end with respect to each ink tank 11 by the ink residual amount determination portion 44, and includes the above-described predetermined value A and the predetermined value B. The predetermined value A and the predetermined value B are values which are set for each ink tank 11, that is, for each type of ink IK.

The reset processing is processing for refilling the ink tank 11 which is determined as the ink low or the ink end with the ink IK and initializing (returning to the initial value) the count value of the ink consumption amount. The reset processing is performed as the user presses the reset button of the operation panel ill. When the reset processing is performed by a manual operation of the user, and the liquid surface lowering determination portion 43 performs the ink presence detection and confirms that the ink IK is present, among the count end flag 54, the sensor end flag 55, and the ink end flag 56, with respect to the set flag, the flag is released, the count value stored in the approximate consumption amount count 51 and the after-detection consumption amount count 52 returns to the initial value, and the calculation of the ink consumption amount is started.

In addition, regardless whether or not the residual amount (consumption amount) of the ink IK, or the count end flag 54, the sensor end flag 55, and the ink end flag 56 are set, the reset processing by the manual operation of the user can be performed any time by pressing the reset button.

In the example, by considering a case where the user forgets to press the reset button even though the user refills the ink tank 11 with the ink IK, under a specific condition even in a case where the user does not press the reset button, the count end flag 54 is released, and "automatic reset processing" of making the count value stored in the approximate consumption amount count 51 and the after-detection consumption amount count 52 return to the initial value is performed. The "automatic reset processing" will be described later, but the processing is different from the "reset processing by the manual operation of the user", and the count end flag 54, the sensor end flag 55, and the ink end flag 56 are not released.

Concept of Ink Residual Amount Management

A concept of the residual amount management of the ink IK according to the example will be described with reference to FIG. 5. FIG. 5 is a view schematically illustrating the ink residual amount management in the ink tank according to the example. In FIG. 5, a residual amount levels L0 to L5 of the ink IK inside the ink tank 11 is schematically illustrated. In FIG. 5, an upward-and-downward direction corresponds to the size of the volume, and the residual amount of the ink IK increases when approaching an upper part until the residual amount level L5 from the residual amount level L0 by considering a lower part as a bottom portion side.

The residual amount level L0 is the lowest level of the residual amount of the ink IK, and is the level which is a standard of the maximum consumable volume of the ink tank 11. In the residual amount level L0, the "ink end" in which the ink IK in the ink tank 11 is not present is determined, and the ink end flag 56 is set. In addition, the ink end notification is displayed to the user, and the printing operation of the printer 110 (refer to FIG. 2) is stopped.

In addition, even in the residual amount level L0, in order to prevent the blank driving state, a predetermined amount C0 of the ink IK which is required for preventing the blank driving in the ink tank 11 remains. In addition, even in the flow path between the ink tank 11 and the printing head 22 (refer to FIG. 2), the ink IK remains. Therefore, the user operates the printer 110 until the ink IK in the ink tank 11 reaches the residual amount level L0, and the ink IK can be consumed without generating the blank driving.

The residual amount level L1 corresponds to the residual state where a predetermined amount C1 of the ink IK remains until reaching the residual amount level L0. The predetermined amount C1 corresponds to the predetermined value B of the count value. In other words, the difference value between the count value when reaching the residual amount level L1, and the count value when reaching the residual amount level L0 by consuming the predetermined amount C1 of the ink IK from the residual amount level L1, is the predetermined value B. In the residual amount level L1, the "ink low" in which the amount of the ink IK in the ink tank 11 is small is determined, and the ink low notification for prompting the user to refill the ink tank 11 with the ink IK is displayed.

From the residual amount level L1 to the residual amount level L0 by consuming the predetermined amount C1 of the ink IK, it is required for the user to refill the ink tank 11 with the ink IK. It is desirable that the refill ink IK is prepared at hand of the user, but there can be a case where the ink is out of stock. Here, predetermined lead time (for example, one week) for arranging the refill ink IK by the user after the ink low notification is displayed is assumed, and the consumption amount of each ink IK consumed during this period is estimated and considered as the predetermined amount C1 (predetermined value B). In addition, a printer vender may set the lead time from a total result of a use state of the printer 110 by a printer user.

The residual amount level L2 is the level in which the ink presence detection is performed, the "sensor end" is determined, and the sensor end flag 55 is set, and which corresponds to the predetermined height. The residual amount level L2 corresponds to the residual state in which the predetermined amount C2 of the ink IK remains until reaching the residual amount level L1.

The predetermined amount C2 corresponds to the predetermined value A of the count value. In other words, the difference value between the count value when reaching the residual amount level L2, and the count value when reaching the residual amount level L1 by consuming the predetermined amount C2 of the ink IK from the residual amount level L2, is the predetermined value A.

As described above, there is a case where it is determined that the ink IK is present at the predetermined height in the following ink presence detection after it is determined that the ink IK is not present at the predetermined height by the ink presence detection. In order to prevent the user from being confused in this case, after the sensor end is determined in the residual amount level L2, the ink presence detection is stopped until reaching the residual amount level L1 by consuming the predetermined amount C2 (predetermined value A) of the ink IK. It is preferable that the predetermined amount C2 is less than the predetermined amount C0 which is for preventing the blank driving.

The residual amount level L3 corresponds to the residual state in a case where the user refills the ink tank 11 with the entire amount of the ink IK accommodated in the refill bottle in a state of the residual amount level L0, that is, when the ink end notification is displayed. Therefore, when the amount of the ink IK which can be consumable from the residual amount level L3 to the residual amount level L2 in which the sensor end is achieved becomes the predetermined amount C3, the total of the predetermined amount C1, the predetermined amount C2, and the predetermined amount C3 is equivalent to the entire amount of the ink IK accommodated in the refill bottle.

The residual amount level L4 corresponds to the residual state in a case where the user refills the ink tank 11 with the entire amount of the ink IK accommodated in the refill bottle in a state of the residual amount level L1, that is, when the ink low notification is displayed. Therefore, when the amount of the ink IK from the residual amount level L4 to the residual amount level L3 becomes the predetermined amount C4, the predetermined amount C4 is equivalent to the predetermined amount C1, and the total of the predetermined amount C2, predetermined amount C3, and the predetermined amount C4 is equivalent to the entire amount of the ink IK accommodated in the refill bottle.

The residual amount level L5 corresponds to an upper limit level of the residual amount of the ink IK. In the residual amount level L5, a predetermined amount C5 which is a margin for preventing the ink IK from overflowing from the ink tank 11 when the user refills the ink tank 11 with the entire amount of the ink IK accommodated in the refill bottle in the residual amount level L1, is added to the residual amount level L4.

As described above, the determination and the notification of the ink low are performed based on comparison of the count value of the ink IK consumption amount after the sensor end and the predetermined value A. Here, when the consumption amount of the ink IK which is practically ejected from the printing head 22 and consumed is less than the count value based on the image data to be printed, the amount of the ink IK consumed until the ink low is notified from the state of the residual amount level L2 which is the sensor end, becomes less than the predetermined amount C2 (predetermined value A).

In a case where the actual consumption amount of the ink IK is less than the count value, when the user refills the ink tank 11 with the entire amount of the ink IK accommodated in the refill bottle at the moment when the ink low notification is displayed, the ink IK becomes greater (higher) than the residual amount level L4. In this case, since there is room for predetermined amount C5 in the volume of the ink tank 11, it is possible to prevent the ink IK from overflowing from the ink tank 11. It is preferable that the predetermined amount C5 is greater than the predetermined amount C2, and that the predetermined amount C5 is less than the predetermined amount C0.

According to this configuration, the volume of the ink tank 11 is greater than the volume of the refill bottle only as the total of the predetermined amount C4 (or the predetermined amount C1) and the predetermined amount C5. Therefore, the user can consume at least the total amount of the predetermined amount C1, predetermined amount C2, and the predetermined amount C3 of the ink IK from a state where the user refills the ink tank 11 with the entire amount of the ink IK accommodated in the refill bottle.

In addition, the user can consume the total amount of the predetermined amount C1, the predetermined amount C2, the predetermined amount C3, the predetermined amount C4, and the predetermined amount C5 of the ink IK from the residual amount level L5, that is, a state where the user fills the ink tank 11 with the ink IK. Therefore, the total of the predetermined amount C1, the predetermined amount C2, the predetermined amount C3, the predetermined amount C4, and the predetermined amount C5 is the maximum consumable volume of the ink tank 11.

When the user performs the printing and consumes the ink IK, it is desirable that the user refills the ink tank 11 with the entire amount of the ink IK accommodated in the refill bottle until the residual amount of the ink IK reaches the residual amount level L0 in which the ink end notification is displayed and the printing operation is stopped after reaching the residual amount level L1 in which the ink low notification is displayed. In addition, it is desirable that the user performs the reset processing to an extent of refilling the ink tank 11 with the entire amount of ink IK of the refill bottle.

When the user refills the ink tank 11 with the ink IK and performs the reset processing as described above, a large deviation between the consumption amount of the ink IK based on the count value, and the actual consumption amount of the ink IK is not generated, and accordingly, the reference of the residual amount of the ink IK displayed on the monitor, such as the computer 49 (refer to FIG. 2), corresponds to the actual residual amount of the ink IK.

However, a using method of the user is various, and for example, there can be a case where a small amount of the ink IK is repeatedly refilled before the ink low notification is displayed, and there can be a case where the reset processing is not performed (or the user forgets to perform the reset processing) even when the ink IK is refilled when the ink low notification is displayed. Then, a deviation between the consumption amount of the ink IK based on the count value and the actual consumption amount of the ink IK is generated.

In addition, an ink residual amount display shows a value of a ratio of "the count value (approximate consumption amount count value) which is updated every time with respect to the count value that corresponds to the total of the predetermined amount C1, the predetermined amount C2, and the predetermined amount C3" by using a case where one refill bottle is refilled in the residual amount level L0 as a standard. However, after reaching the count value which corresponds to the predetermined amount C3, until the sensor end flag 55 is set, the approximate consumption amount count value is fixed and displayed based on the value of the ratio of "the count value which corresponds to the predetermined amount C3 with respect to the count value that corresponds to the total of the predetermined amount C1, the predetermined amount C2, and the predetermined amount C3".

Here, a printer in which the user can refill the inside with the ink IK as described in the example, and which is configured to determine the ink low and the ink end based on the count value from the time when the counting is started without a sensor which performs the ink presence detection similar to the printer described in JP-A-2012-152995, is assumed. In the printer, when the deviation between the consumption amount of the ink based on the count value that corresponds to the approximate consumption amount count and the actual ink consumption amount increases, there is a concern that the difference between the residual amount of the ink assumed based on the count value and the actual residual amount of the ink increases, and the ink low and the ink end are correctly determined.

Therefore, in a case where the residual amount assumed based on the count value is less than the actual residual amount, an incorrect warning of the ink low or the ink end is given based on the count value even though the ink is present in the ink tank, and this bothers the user. Meanwhile, in a case where the residual amount assumed based on the count value is greater than the actual residual amount, a warning of the ink end is not given even though the ink is not present in the ink tank, and the blank driving state is generated.

In the example, by performing the ink presence detection by the sensors (one pair of electrodes 15 and 16), the sensor end in which the ink IK is not present at the predetermined height in the ink tank 11 is determined. In addition, the ink low is determined when the count value of the consumption value of the ink IK after the sensor end is determined is equal to or greater than the predetermined value A, and further, the ink end is determined when the count value after the ink low is determined is equal to or greater than the predetermined value B.

For example, as the user repeatedly pours and refills the small amount of ink IK, even when the deviation between the consumption value of the ink IK based on the count value and the actual consumption value of the ink IK increases, the ink low and the ink end are determined based on the difference value of the count value by considering the time when the sensor end is determined as a standard. Therefore, in the example, since it is possible to more correctly determine the ink low and the ink end, it is possible to suppress the generation of the blank driving state.

However, when the deviation between the consumption value of the ink IK based on the count value and the actual consumption value of the ink IK increases, the reference of the residual amount of the ink IK displayed on the monitor of the computer 49 based on the count value becomes different from the actual residual amount of the ink IK. In addition, in a case where malfunction is generated in the mechanism which performs the ink presence detection by the sensor and the sensor end cannot be determined for any reason, there is a concern that the blank driving state is generated.

Here, in the example, the count value of the ink consumption amount until the residual amount level L0 from the residual amount level L5 which corresponds to the maximum consumable volume of the ink tank 11 is considered as the predetermined limit value, and a state where the count value reaches the predetermined limit value becomes count end. The amount of the ink IK which can be consumed by the user in counting is the largest from the time when the counting is started in the residual amount level L5, to the time when the count value reaches the predetermined limit value that corresponds to the maximum consumable volume of the ink tank 11. Therefore, in a case where the count value exceeds the predetermined limit value, it is determined that the deviation between the consumption amount (residual amount) of the ink IK based on the count value and the actual consumption amount (residual amount) of the ink IK is generated.

When the count value reaches the predetermined limit value and the count end is achieved, the count end flag 54 is set. When the count end flag 54 is set, with respect to the ink tank 11 in which the count end flag 54 is set, the control portion 40 (refer to FIG. 2) generates data (first data) for displaying a "periodic notification" (first message) which prompts the user to visually confirm the residual amount of the ink IK in the ink tank 11, and outputs the data to the display portion 47 (refer to FIG. 2), and the display portion 47 periodically displays the notification based on the data.

Accordingly, in a case where the reference of the residual amount of the ink IK displayed on the monitor of the computer 49 based on the count value is different from the actual residual amount of the ink IK, as the user visually confirms the residual amount of the ink IK, it is possible to make the user notice that the residual amount of the ink IK displayed on the monitor is different from the actual amount. In addition, in a case where malfunction is generated in the mechanism which performs the ink presence detection by the sensor for any reason, it is possible to bring the malfunction to the attention of the user by prompting the user to visually confirm the residual amount of the ink IK.

In addition, in the example, as illustrated in FIG. 4B, the volume of the ink tank 11*a* in which the black ink IKa is accommodated is greater than the volumes of the ink tanks 11*b*, 11*c*, and 11*d*. Therefore, the predetermined amounts C1, C2, C3, C4, and C5, and the predetermined values A and B with respect to the ink tank 11*a* are set to be greater than the predetermined amounts C1, C2, C3, C4, and C5, and the predetermined values A and B with respect to the ink tanks 11*b*, 11*c*, and 11D, but a relative relationship between the volumes of each ink tank 11 and the volumes of refill bottles that correspond thereto is the same as that in the description above.

In addition, even when the predetermined values A and B with respect to the ink tank 11*a* are different from the predetermined values A and B with respect to the ink tanks 11*b*, 11*c*, and 11*d*, the predetermined heights from the bottom portions of the ink tanks 11*a*, 11*b*, 11*c*, and 11*d* when performing the ink presence detection by the sensors (one pair of electrodes 15 and 16) are set to be the same as each other. Accordingly, in the ink tank 11*a*, and the ink tanks 11*b*, 11*c*, and 11*d*, which have different volumes from each other, it is possible to commonly use one pair of electrodes 15 and 16, and to easily dispose the detection substrate 14.

Ink Residual Amount Management Method

Figure 6:
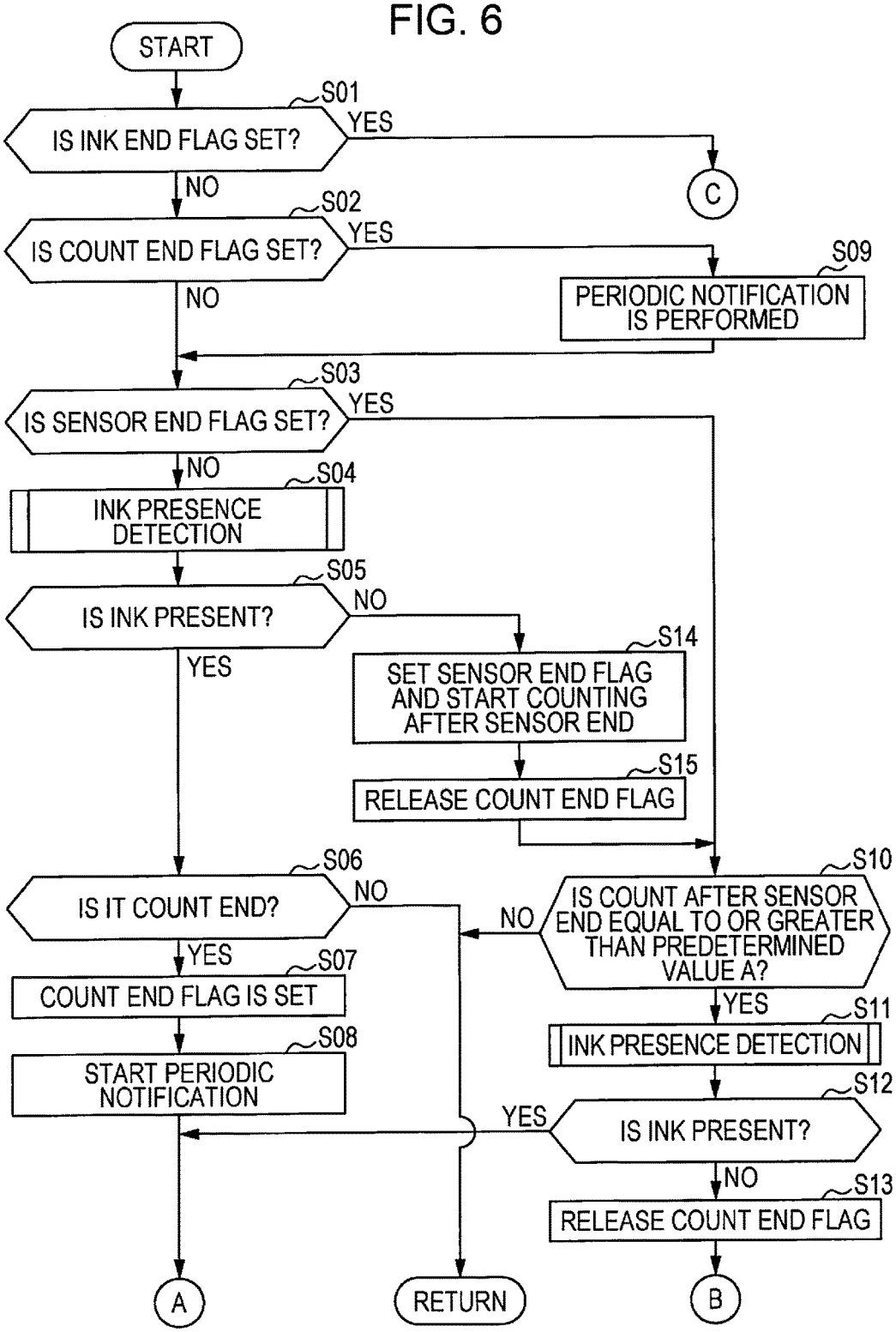
FIG. 6 is a flowchart illustrating an ink residual amount management method (first example) of the printer according to the embodiment.
Figure 7:
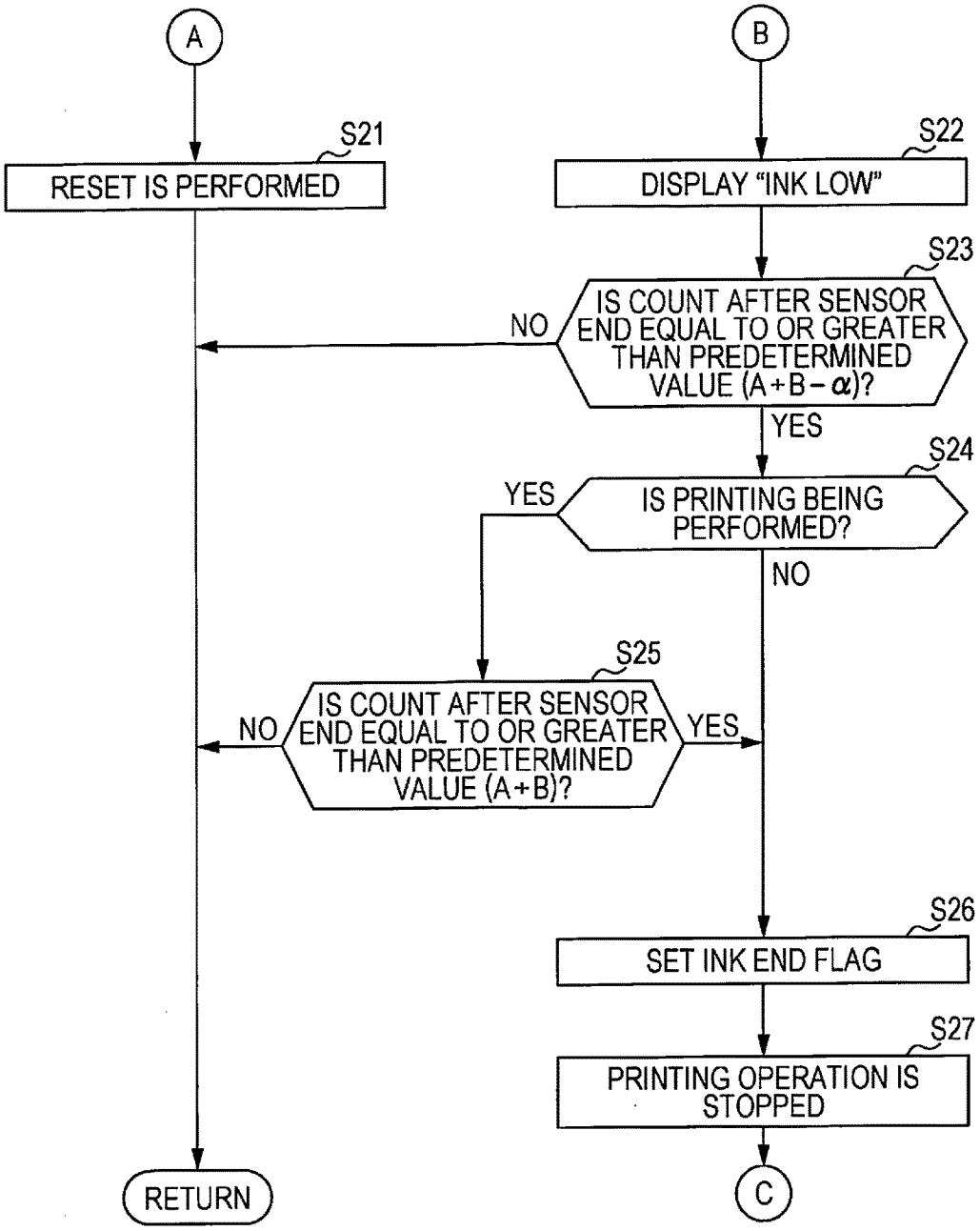
FIG. 7 is a flowchart illustrating the ink residual amount management method (first example) of the printer according to the embodiment.
Figure 8:
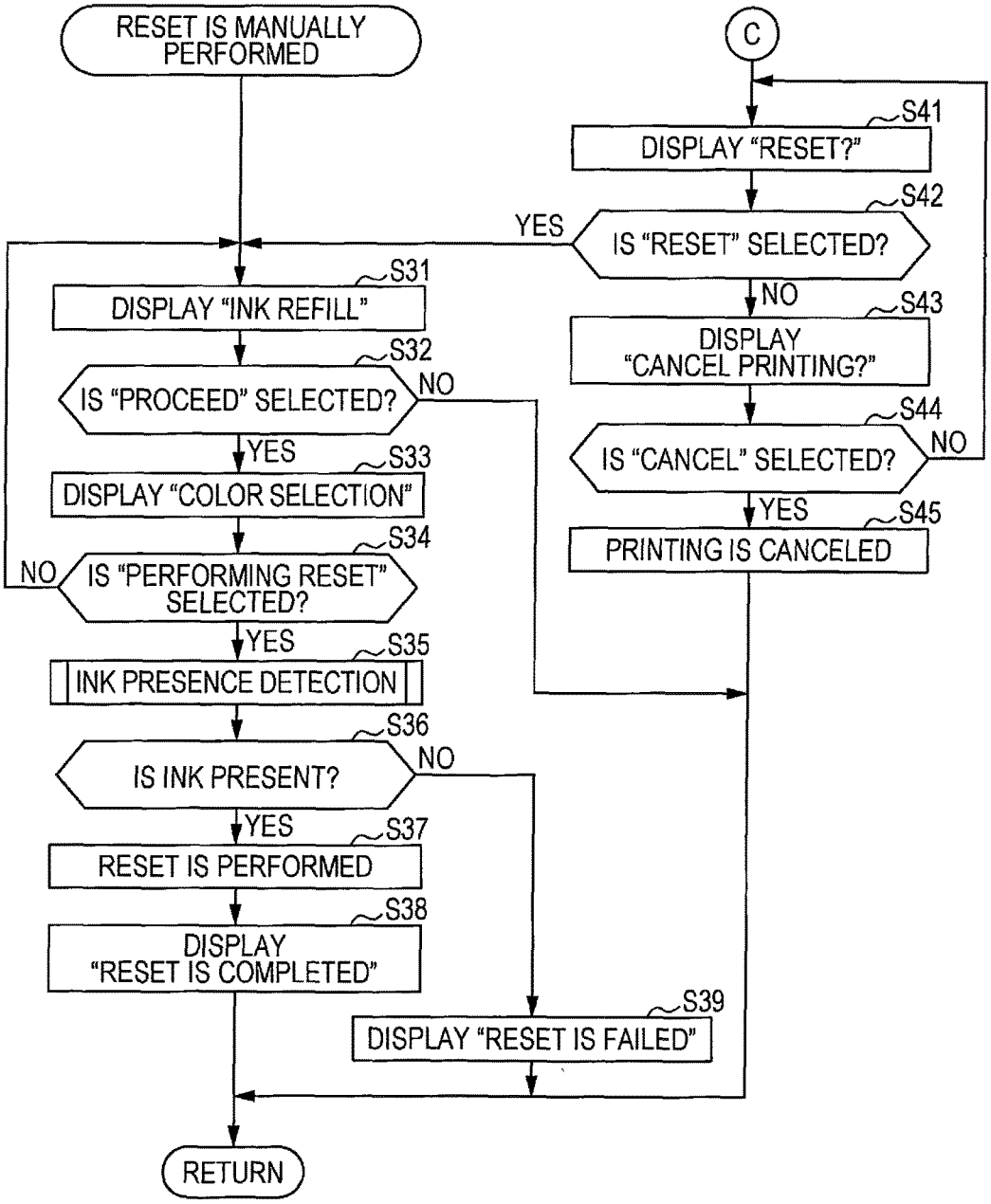
FIG. 8 is a flowchart illustrating the ink residual amount management method (first example) of the printer according to the embodiment.

Next, an ink residual amount management method in the printer according to the example will be described with reference to FIGS. 6, 7, and 8. FIGS. 6, 7, and 8 are flowcharts illustrating the ink residual amount management method in the printer according to the example. In addition, in the description below, each portion included in the control portion 40 of the printer 110 are generally and simply described as the control portion 40.

In the example, when the processing of each step of the flowcharts illustrated in FIGS. 6, 7, and 8 is performed when the power of the printer 110 is turned ON, when receiving the printing job from the user, or when the cleaning is performed for each unit consumption amount (every time when the difference value between the current count value and the previous count value becomes the unit consumption value) of the ink IK based on the approximate consumption amount count value.

In addition, the control portion 40 (refer to FIG. 2) consecutively selects the ink tank 11 to be a target among the ink tanks 11*a*, 11*b*, 11*c*, and 11*d* (refer to FIG. 4B), and performs the processing of each step with respect to the selected ink tank 11. In addition, the processing of each step is performed with respect to all of the ink tanks 11 provided in the printer 110.

As described above, after the reset processing is performed, the control portion 40 calculates the ink consumption amount by considering the ink consumption amount count which is a ratio of the ink consumption amount based on the volume of one refill bottle as the initial value (100% of the ink consumption amount), and stores the approximate consumption amount count 51 calculated for each ink tank 11 in the storage portion 50 (refer to FIG. 2). In addition, with respect to the ink tank 11 determined as the sensor end, the control portion 40 computes from the count value when it is lastly determined that the ink IK is present at the predetermined height before the sensor end is determined, calculates the ink consumption amount after the sensor end, and stores the after-detection consumption amount count 52 calculated with respect to the ink tank 11 in the storage portion 50. In addition, the predetermined values A and B with respect to each ink tank 11 are stored in the storage portion 50 as the determination information 53.

First, in step S01 illustrated in FIG. 6, the control portion 40 determines whether or not the ink end flag 56 is set in the storage portion 50. In a case where it is determined that the ink end flag 56 is not set (step S01: NO), the control portion 40 proceeds the processing to step S02.

Meanwhile, a case where it is determined that the ink end flag 56 is set (step S01: YES) means that the ink end is achieved and the printing operation is stopped. In this case, the control portion 40 proceeds the processing to step S41 of FIG. 8 which will be described later, and performs the display which prompts the user to perform the reset with respect to the ink tank 11 in which the ink end flag 56 is set. In addition, in a case where the ink end flag 56 is set in any of the ink tanks 11, the printer 110 cannot be in a state where the printing operation is possible until the reset processing is performed by the user.

In step S02, the control portion 40 determines whether or not the count end flag 54 is set in the storage portion 50. In a case where it is determined that the count end flag 54 is not set (step S02: NO), the control portion 40 proceeds the processing to step S03.

Meanwhile, in a case where it is determined that the count end flag 54 is set (step S02: YES), the control portion 40 proceeds the processing to step S09, performs the periodic notification, and proceeds the processing to step S03. In the periodic notification of step S09, the first message which prompts the user to visually confirm the residual amount of the ink IK in the ink tank 11 is repeatedly displayed on the display portion 47 (refer to FIG. 2).

As described above, a case where the count end flag 54 is set means that the amount of the ink IK which is equal to or greater than the maximum consumable volume of the ink tank 11 is consumed in the approximate consumption amount count. Therefore, a case where the count end flag 54 is set even though the ink end flag 56 is not set (the residual amount of the ink IK is present), indicates that the deviation between the approximate consumption amount count value and the actual amount used of the ink IK is generated, and it is desirable that the user visually confirms the residual amount of the ink IK. Here, while the count end flag 54 is set, when YES is determined in step S02, the periodic notification of step S09 is performed.

In addition, even though the ink end flag 56 is not set, in a case where the count end flag 54 is set, there is a case where a defect is generated in the mechanism which performs the ink presence detection by the sensors (one pair of electrodes 15 and 16) or the detection circuit, and it is not detected that the ink IK is not present at the predetermined height of the ink tank 11. Even in this case, by visually confirming the residual amount of the ink IK, the user can visually confirm that the ink IK in the ink tank 11 is used up, and as a result, it is possible to make the user notice the defect of the mechanism which performs the ink presence detection.

In step S03, the control portion 40 determines whether or not the sensor end flag 55 is set in the storage portion 50. In a case where it is determined that the sensor end flag 55 is not set (step S03: NO), the control portion 40 proceeds the processing to step S04. Meanwhile, in a case where it is determined that the sensor end flag 55 is set (step S03: YES), the control portion 40 proceeds the processing to step S10 which will be described later.

In step S04, the control portion 40 performs the ink presence detection by the sensors (one pair of electrodes 15 and 16). In addition, in the following step S05, the control portion 40 determines whether or not the ink IK is present at the predetermined height (residual amount level L2 illustrated in FIG. 5) in the ink tank 11 based on the result of the ink presence detection.

In a case where it is determined that the ink IK is present at the predetermined height in the ink tank 11 (step S05: YES), the control portion 40 proceeds the processing to step S06. Meanwhile, in a case where it is determined that the ink IK is not present at the predetermined height in the ink tank 11, that is, in a case where the sensor end is determined (step S05: NO), the control portion 40 proceeds the processing to step S14 which will be described later.

In step S06, with reference to the approximate consumption amount count 51 stored in the storage portion 50, the control portion 40 determines whether or not the count end is determined, that is, whether or not the approximate count value reaches the predetermined limit value. In a case where the count end is determined (step S06: YES), the control portion 40 proceeds the processing to step S07. Meanwhile, in a case where the count end is not determined (step S06: NO), the control portion 40 makes the processing return to the start.

In step S07, the control portion 40 sets the count end flag 54 in the storage portion 50 with respect to the ink tank 11 which is determined as the count end. In the following step S08, the control portion 40 starts the periodic notification (first message) in order to prompt the user to visually confirm the residual amount of the ink IK in the ink tank 11.

Next, in step S21 illustrated in FIG. 7, the control portion 40 performs the "automatic reset processing" with respect to the ink tank 11 in which the count end flag 54 is set. In other words, even when the user does not perform the reset processing by the manual operation, the count value stored in the approximate consumption amount count 51 with respect to the ink tank 11 in which the count end flag 54 is set returns to the initial value. In a case of moving on from step S12 to step S21, the count value stored in the after-detection consumption amount count 52 returns to the initial value together with the count value stored in the approximate consumption amount count 51. In addition, the control portion 40 makes the processing return to the start. Accordingly, the counting of the ink consumption amount is restarted with respect to the ink tank 11 in which the count end flag 54 is set.

In the processing until step S21, even though it is determined that the ink IK is present at the predetermined height in step S05, in a case where the count end is determined in the next step S06, it is possible to determine that the deviation between the count value and the actual amount used of the ink IK is generated.

Here, with respect to ink tank 11 to be a target, the control portion 40 sets the count end flag 54 in step S07, starts the periodic notification in step S08, and then, makes the count value return to the initial value in step S21.

In addition, the performing of the reset processing in step S21 is not based on the filling of the ink IK and the manual operation of the user. Therefore, even after the count value returns to the initial value by performing the reset processing, until the ink end flag 56 or the sensor end flag 55 is set, the periodic notification (performing the periodic notification in step S09) to the user is performed, and this prompts the user to pay attention to the residual amount of the ink IK.

Returning to FIG. 6, with respect to the ink tank 11 which is determined as the sensor end in step S05 (step S05: NO), the control portion 40 sets the sensor end flag 55 in the storage portion 50, and starts the counting of the consumption amount after the sensor end in step S14. The counting of the consumption amount after the sensor end is a count value which is computed from the approximate consumption amount count value when it is lastly determined that the ink IK is present at the predetermined height in advance, when the sensor end is determined in step S05, and is stored in the storage portion 50 as the after-detection consumption amount count 52.

Next, in step S15, in a case where the count end flag 54 is set in the storage portion 50 with respect to the ink tank 11 in which the sensor end flag 55 is set, the control portion 40 releases the count end flag 54. In addition, the control portion 40 stops the periodic notification.

As described above, in a case where it is determined that the count end flag 54 is set in step S02, whether the deviation between the count value and the actual amount used of the ink IK is generated, or the defect is generated in the mechanism which performs the ink presence detection, is considered. Therefore, the control portion 40 performs the periodic notification in step S09, and prompts the user to visually confirm the residual amount of the ink IK.

After this, a case where the sensor end is determined in step S05 means that the mechanism which performs the ink presence detection normally functions, and also means that the ink IK of the residual amount level L2 remains at the moment of the determination in the ink tank 11 to be a target. Therefore, since the approximate consumption amount count value can be corrected based on the actual residual amount of the ink IK, the control portion 40 releases the count end flag 54 of the ink tank 11 to be a target in step S15. In addition, the control portion 40 proceeds the processing to step S10.

In addition, the ink residual amount display after the sensor end flag 55 is set shows the value of the ratio of "the count value which corresponds to the total of the predetermined amount C3 and the after-detection consumption amount count 52 with respect to the count value which corresponds to the total of the predetermined amount C1, the predetermined amount C2, and the predetermined amount C3". However, after reaching the count value which corresponds to the total of the predetermined amount C1 and the predetermined amount C2, the after-detection consumption amount count 52 is fixed and displayed by the weight of one refill bottle (for example, a case where all of the ink amount which correspond to the total of the predetermined amount C1, predetermined amount C2, and the predetermined amount C3 illustrated in FIG. 5 which will be described later are consumed is displayed by 100% of ink consumption amount (or no residual amount of ink)) or the like.

In step S10, it is determined whether or not the count of the consumption amount after the sensor end, that is, the count value which is stored in the after-detection consumption amount count 52 is equal to or greater than the predetermined value A. In a case where it is determined that the Count of the consumption amount after the sensor end is equal to or greater than the predetermined value A (step S10: YES), the control portion 40 proceeds the processing to step S11. Meanwhile, in a case where the count of the consumption amount after the sensor end is less than the predetermined value A (step S10: NO), the control portion 40 makes the processing return to the start.

In addition, a case where the count of the consumption amount after the sensor end is equal to or greater than the predetermined value A means that the ink IK in the ink tank 11 to be a target is in the ink low state of being equal to or less than the residual amount level L1 illustrated in FIG. 5 in counting. In addition, a case where the count of the consumption amount after the sensor end is less than the predetermined value A means that the ink IK in the ink tank 11 to be a target is greater than the residual amount level L1 in counting.

In step S11, the control portion 40 performs the ink presence detection by the sensors (one pair of electrodes 15 and 16) with respect to the ink tank 11 to be a target. In addition, in the following step S12, the control portion 40 determines whether or not the ink IK is present at the predetermined height in the ink tank 11 to be a target based on the result of the ink presence detection. In a case where it is determined that the ink IK is not present at the predetermined height (step S12: NO), the control portion 40 proceeds the processing to step S13. Meanwhile, in a case where it is determined that the ink IK is present at the predetermined height (step S12: YES), the control portion 40 proceeds the processing to step S21 of FIG. 7.

An object of performing step S11 and step S12 after step S10 is to make the user confirm whether or not the ink tank 11 is refilled with the ink IK before the ink low is notified after determining the sensor end in step S04 and step S05. The user can refill the ink tank 11 with the ink IK at any time even before the ink low notification is displayed. In addition, there can be a case where the user does not perform the reset processing by the manual operation after refilling the ink IK.

In a case where it is determined that the ink IK is present in step S12 (step S12: YES), since the ink IK which exceeds the residual amount level L2 illustrated in FIG. 5 is present in the ink tank 11 to be a target, it is considered that the user refilled the ink IK after step S04 and step S05. Therefore, since it is apparent that the deviation between the count value and the actual amount used of the ink IK is generated, the control portion 40 proceeds the processing to step S21, and performs the reset processing with respect to the ink tank 11 to be a target.

Here, in a case where it is determined that the sensor end flag 55 is set in step S03 (step S03: YES), and the processing moves on to step S10, until the count of the consumption amount after the sensor end in step S10 becomes equal to or greater than the predetermined value A, the ink presence detection is not performed by the sensor. This is for preventing the determination that the ink IK is present by the ink presence detection after determining the sensor end in the ink presence detection because of the inclination of the printer 110 or the bubbles of the ink IK, as described above.

With respect to the ink tank 11 in which it is determined that the ink IK is not present at the predetermine height in step S12 (step S12: NO), in a case where the count end flag 54 is set in the storage portion 50 in step S13, the control portion 40 releases the count end flag 54 of the ink tank 11 to be a target. In addition, the control portion 40 stops the periodic notification.

A case where it is determined that the ink IK is not present in step S12 means that the mechanism which performs the ink presence detection normally functions, and since the count of the consumption amount after the sensor end is equal to or greater than the predetermined value A, it is possible to determine that the ink IK in the ink tank 11 to be a target is in the ink low state. Therefore, the control portion 40 releases the count end flag 54 in step S13. In addition, the control portion 40 proceeds the processing to step S22 illustrated in FIG. 7.

Here, the count end flag 54 is released in step S15, but a case where the count end flag 54 is not released in step S15 due to the influence of the electrostatic noise or the like is considered, and the count end flag 54 is released in step S13. In this manner, in a case where the approximate ink consumption amount count and the actual ink consumption amount match each other, it is possible to prevent the periodic notification from being performed in step S09 even though the notification is not necessary.

In step S22, the control portion 40 generates the ink low notification (second data) for prompting the user to refill the ink IK, and outputs the ink low notification to the display portion 47, and the display portion 47 displays the ink low notification (second message). In addition, the ink IK in the ink tank 11 to be a target becomes the residual amount level L4 illustrated in FIG. 5 when the user refills the ink tank 11 with the entire amount of the ink IK in the refill bottle, at the moment when the ink low notification is displayed, that is, when reaching the residual amount level L1 illustrated in FIG. 5.

In step S23, the control portion 40 determines whether or not the count of the consumption amount after the sensor end, that is, the count value stored in the after-detection consumption amount count 52 becomes equal to or greater than the predetermined value (A+B−α), with respect to the ink tank 11 to be a target. In a case where it is determined that the count of the consumption amount after the sensor end becomes equal to or greater than a predetermined value (A+B−α) (step S23: YES), the control portion 40 proceeds the processing to step S24. Meanwhile, in a case where the count of the consumption amount after the sensor end is less than the predetermined value (A+B−α) (step S23: NO), the control portion 40 makes the processing return to the start.

Step S23 is processing for preventing the ink end in the middle of the printing job when the printing is performed based on the operation of the user, and the stop of the printing. When the count of the consumption amount after the sensor end is equal to or greater than a predetermined value (A+B), that is, when the ink end of the residual amount level L0 illustrated in FIG. 5 is achieved, in order to prevent the blank driving state, the printing operation is stopped even in the middle of the printing job. Therefore, in order to prevent the printing operation from being stopped in the middle of the printing job, it is desirable that the printing operation is stopped before the user performs the operation of performing the printing slightly before the ink end. In addition, a predetermined value a is set to be smaller than the predetermined value A and the predetermined value B, and is set to be greater than the unit consumption amount of the ink IK which performs an ink residual amount management flow.

In step S24, the control portion 40 determines whether or not the printing job is being performed. In a case where the printing job is being performed (step S24: YES), the control portion 40 proceeds the processing to step S25. In a case where the printing job is not being performed (step S24: NO), the control portion 40 proceeds the processing to step S26.

In step S25, the control portion 40 determines whether or not the count of the consumption amount after the sensor end, that is, the count value stored in the after-detection consumption amount count 52 is equal to or greater than the predetermined value (A+B), with respect to the ink tank 11 to be a target. In a case where the count of the consumption amount after the sensor end is equal to or greater than the predetermined value (A+B), that is, in a case where the ink end is determined (step S25: YES), the control portion 40 proceeds the processing to step S26. Meanwhile, in a case where the count of the consumption amount after the sensor end is less than the predetermined value (A+B), and the ink end is not determined (step S25: NO), the control portion 40 makes the processing return to the start.

In step S26, the control portion 40 sets the ink end flag 56 in the storage portion 50 with respect to the ink tank 11 to be a target. In addition, in step S27, the control portion 40 stops the printing operation of the printer 110, and proceeds the processing to step S41 illustrated in FIG. 8. Therefore, when the sensor end is determined in step S25 while performing the printing job, the printing operation is stopped in the middle of the printing job. When the printing operation is stopped in step S27, the printing operation cannot be started until the user performs the reset by the manual operation.

In step S41 illustrated in FIG. 8, the control portion 40 displays a message "Do you perform reset processing?" on the display portion 47, and prompts the user to refill the ink tank 11 with the ink IK and perform the reset processing. In step S41, the user can select whether the reset processing is performed (YES) or the reset processing is not performed (NO).

In the following step S42, the control portion 40 determines whether or not the reset processing is selected to be performed by the operation of the user. In a case where it is determined that the reset processing is selected to be performed (step S42: YES), the control portion 40 proceeds the processing to step S31. Meanwhile, in a case where the reset processing is selected not to be performed (step S42: NO), the control portion 40 proceeds the processing to step S43.

In step S43, the control portion 40 displays a message "Do you cancel printing job?" on the display portion 47, and prompts the user to select whether or not to cancel the printing job. In step S43, the user can select any of cancelling (YES) or not-cancelling (NO).

In the following step S44, the control portion 40 determines whether or not the printing job is selected to be canceled by the operation of the user. In a case where it is determined that the printing job is selected to be canceled (step S44: YES), the control portion 40 proceeds the processing to step S45. Meanwhile, in a case where the printing job is selected not to be canceled (step S44: NO), the control portion 40 makes the processing return to step S41.

In step S45, the printing job is canceled based on the selection of the user. After the printing job is canceled, until the user performs the reset by the manual operation, a state where the printing operation of the printer 110 is stopped is maintained. In addition, in the printer system 100, it is also possible to read the document by the scanner 120 in this state. Therefore, even in a case where the refill ink IK is not prepared at hand of the user and the ink IK cannot be refilled, it is possible to use the scanner 120.

As described above, when it is determined that the reset processing is selected to be performed in step S42 (step S42: YES), the processing is moves on to step S31. In addition, regardless of in which steps described above the processing is, when the user presses the reset button of the operation panel 111, it is possible to manually perform the reset processing, and in this case, the processing of step S31 is performed.

In step S31, the control portion 40 displays a message "Please refill ink" on the display portion 47, and prompts the user to refill the ink tank 11 with the ink IK. In step S31, the user can select any of proceeding the ink refill (YES) or cancelling the ink refill (NO).

In the following step S32, the control portion 40 determines whether or not to select to proceed the ink refill by the operation of the user. In a case where it is determined that the ink refill is selected to be proceeded (step S32: YES), the control portion 40 proceeds the processing to step S33. Meanwhile, in a case where it is determined that the ink refill is selected to be cancelled (step S32: NO), the control portion 40 makes the processing return to the start.

In step S33, the control portion 40 displays a message "Please select color" on the display portion 47, and prompts the user to confirm which ink tank 11 is filled with which color of the ink IK.

In step S33, the user can select the ink tank 11 to be refilled with the ink IK by the color of the ink IK. In a case where the plurality of ink tanks 11 are present for the same color of the ink IK, the user can select the ink tank 11 to be refilled with the ink IK for each ink tank 11. In addition, after refilling the selected ink tank 11 with the ink IK, the user can perform the reset. In addition, the user can select the processing to return to step S31.

In addition, in a state where the ink end is achieved and the printing operation is stopped, that is, in a state of residual amount level L0 illustrated in FIG. 5 in the ink tank 11, when the user refills the ink tank 11 with the entire amount of the ink IK in the refill bottle, the ink IK in the ink tank 11 becomes the residual amount level L3 illustrated in FIG. 5.

In the following step S34, the control portion 40 determines whether or not the ink tank 11 to be a target is selected by the operation of the user, and the reset is selected to be performed. In a case where it is determined that the reset is selected to be performed (step S34: YES), the control portion 40 proceeds the processing to step S35. Meanwhile, in a case where it is determined that the processing is selected to return to step S31 (step S34: NO), the control portion 40 makes the processing return to step S31.

In step S35, the control portion 40 performs the ink presence detection with respect to the ink tank 11 selected by the user. In addition, in the following step S36, the control portion 40 determines whether or not the ink IK is present at the predetermined height in the ink tank 11 selected by the user based on the result of the ink presence detection. In a case where it is determined that the ink IK is present at the predetermined height (step S36: YES), the control portion 40 proceeds the processing to step S37.

In step S37, since the control portion 40 determines that the ink IK is present at the predetermined height in the ink tank 11 selected by the user, and the user confirms that the ink tank 11 is refilled with the ink IK, the reset processing is performed. In addition, in step S38, the control portion 40 displays that the reset processing is completed on the display portion 47. Accordingly, the count value of the ink consumption amount stored in the approximate consumption amount count 51 and the after-detection consumption amount count 52 with respect to the ink tank 11 selected by the user returns to the initial value. In addition, the control portion 40 makes the processing return to the start. Accordingly, the count of the ink consumption amount is restarted.

Meanwhile, in a case where it is determined that the ink IK is not present at the predetermined height in step S36 (step S36: NO), the control portion 40 proceeds the processing to step S39. In this case, it is considered whether the ink IK is refilled by the user, or the amount of the refilled ink IK is not sufficient. Here, in step S39, the control portion 40 displays that the reset processing is failed with respect to the ink tank 11 to be a target on the display portion 47, with respect to the user. Until the user refills the ink IK and performs the reset, a state where the printing operation of the printer 110 is stopped is maintained.

As described above, according to the ink residual amount management method according to the embodiment, the control portion 40 performs the ink presence detection by the sensors (one pair of electrodes 15 and 16) every time the unit consumption amount of the ink IK is consumed, displays the ink low when the predetermined value A of the ink IK is consumed after the sensor end, and notifies the user the ink low. Therefore, even when the user does not notice the residual amount of the ink IK in the ink tank 11 (even when the user does not visually confirm all the time), in a case where the ink IK is refilled and the reset processing is performed if the ink low notification is displayed, the printing can continue.

In addition, since the ink end is displayed when the predetermined amount (A+B) or more of the ink IK is consumed after the sensor end, the ink end is notified to the user, and the printing operation of the printer 110 is stopped, the blank driving state is prevented.

In addition, if the user refills ink tank 11 with the entire amount of the ink IK accommodated in the refill bottle when the ink low or the ink end is notified, and the reset processing is performed, a large deviation between the count value and the actual amount used of the ink IK is not generated. Therefore, by the reference of the residual amount of the ink IK displayed on the monitor of the computer 49 (refer to FIG. 2) when the user performs the operation of performing the printing, it is possible to ascertain the residual amount of the ink IK in each ink tank 11.

When the user does not care even when the reference of the residual amount of the ink IK displayed on the monitor of the computer 49 is different from the actual residual amount of the ink IK, the user can also pour the ink IK into the ink tank 11 at any time, and continue to use the ink IK. In addition, since the printing operation is not stopped when the ink IK is present in the ink tank 11 even in a case of the count end (when the ink end is not achieved), the user can reduce a burden of being forced to perform an unnecessary operation. In a case where malfunction is generated in the mechanism of performing the ink presence detection by the sensor for any reason, since the periodic notification is performed in order to prompt the user to visually confirm the residual amount of the ink IK, it is possible to make the user notice the malfunction.

Furthermore, the user can manually perform the reset processing by pressing the reset button of the operation panel 111 even at any timing of the ink residual amount management flow.

Therefore, when the user desires to correct the state where the reference of the residual amount of the ink IK displayed on the monitor of the computer 49 is different from the actual residual amount of the ink IK, it is possible to start the reset processing by the manual operation, and to easily correct the state when necessary by refilling the ink IK and performing the reset processing in accordance with the display of the display portion 47.

As described above, in the example, since the control portion 40 performs the control which corresponds to the detection result of the ink residual amount level by the sensors (one pair of electrodes 15 and 16), it is possible to suppress the risk of the blank driving.

Second Example

Next, a second example of the invention will be described with reference to FIG. 9. The example is an example related to ink initial filling. Furthermore, configurations of each portion of the printer in the example are similar to those in the first example which has already been described except for the parts that are not particularly mentioned.

Figure 9:
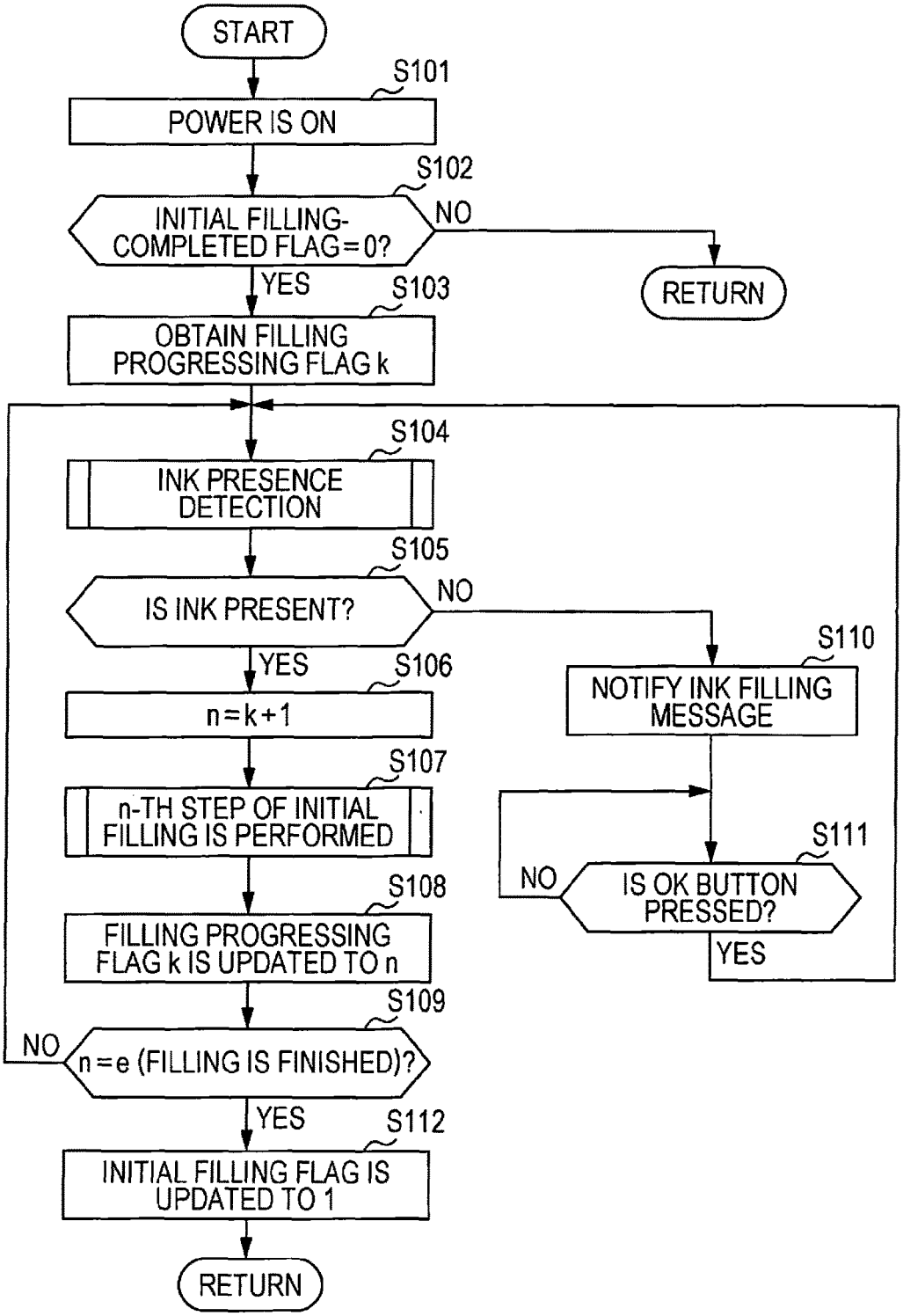
FIG. 9 is a flowchart illustrating a second example (ink initial filling method) of the printer according to the invention.

In FIG. 9, after turning the power ON (step S101), the control portion 40 determines whether or not an "initial filling-completed flag" which is stored in the storage portion 50 (FIG. 2) is "0", that is, whether or not initial filling processing has not been completed in the printer 110 (step S102). The initial filling-completed flag is stored in the storage portion 50 as "0" during the factory shipment of the printer 110, and a case where the initial filling-completed flag is "0" means that the initial filling has not been completed. In addition, a case where the initial filling-completed flag is "1" means that the initial filling is completed.

In a case where the initial filling-completed flag is "0" (the initial filling processing has not completed) (step S102: YES), the processing moves on to step S103. In a case where the initial filling-completed flag is other than "0" (initial filling processing is completed) (step S102: NO), the processing is finished.

In step S103, the control portion 40 obtains a "filling progressing flag k". The filling progressing flag k is a flag which shows until which step the initial filling processing configured of a plurality of steps is completed, is an integer which is equal to or greater than 0, and is stored in the storage portion 50 as "0" during the factory shipment.

In step S104, the control portion 40 performs the ink presence detection by the sensors (one pair of electrodes 15 and 16). In the following step S105, the control portion 40 determines whether or not the ink IK is present at the predetermined height (first threshold value: the residual amount level L2 illustrated in FIG. 5 as an example in the example) in the ink tank 11 based on the result of the ink presence detection.

Furthermore, the ink presence detection of step S104 and the determination in step S105 are performed with respect to all of four ink tanks 11*a*, 11*b*, 11*c*, and 11*d*. Hereinafter, four ink tanks 11*a* to 11*d* are called "all ink tanks 11" hereinafter.

In a case where it is determined that the ink IK is present at the predetermined height in all ink tanks 11 (step S105: YES), the control portion 40 proceeds the processing to step S106. Meanwhile, in a case where the ink IK is not present at the predetermined height, that is, in a case where the sensor end is determined, with respect to at least one of all ink tanks 11 (step S105: NO), the control portion 40 proceeds the processing to step S110.

In step S110, the control portion 40 generates the data for displaying the contents (for example, a message "Please fill A color of ink") in order to prompt the user to fill the ink tank 11 which is determined as the sensor end with the ink IK, and outputs the data to the display portion 47 (FIG. 2). The display of the display portion 47 continues until an OK button is pressed by the user. (step S111).

Meanwhile, in step S106, hereinafter, the step number n of the initial filling to be performed is set to be "k+1". In addition, the n-th step of the initial filling is performed in step S107. Furthermore, although not illustrated in FIG. 9, since the ink IK of the ink tank 11 is consumed by the initial filling, the approximate consumption amount count 51 (FIG. 2) is updated to the latest count value every time during the initial filling processing.

Furthermore, the initial filling in the example is configured of eight steps in total, such as first to eighth steps. In a state where a cap (not illustrated) for performing the maintenance of the printing head 22 seals the printing head 22, the first to fifth steps and the seventh step are steps (suction step) of generating negative pressure in the cap and performing the ink suction from the nozzles of the printing head 22, and the sixth step and the eighth step are steps (flushing step) of performing the ink discharge (flushing) more strongly than the normal time from the nozzles of the printing head 22 with respect to the cap.

When describing more detail, the first step is a step of performing the suction for filling the tube 18 with the ink IK. The second step is a step of performing the suction for filling an adaptor (not illustrated) which connects the tube 18 and the printing head 22 to each other with the ink IK, from the tube 18. The third step to the fifth step are steps of performing the suction for filling the ink flow path in the printing head 22 with the ink IK.

The sixth step is a step of intermittently performing the flushing for approximately 10 minutes while exchanging the standby state for making the ink IK flow to the downstream side while merging the fine bubbles generated in the ink IK when the suction is performed. The seventh step is a step of repeating the suction two times for emitting the bubbles merged in the ink IK. The eighth step is a step of performing the flushing for adjusting the flushing and the nozzle meniscus for emitting the color-mixed ink IK since there is a possibility that plural colors of ink IK are mixed on the nozzle surface of the printing head 22.

In addition, among each step, the standby for stabilizing the state is performed. In addition, the ink amount which is consumed in each step is designed to be less than the minimum ink amount in which it is determined that the ink is present based on the sensors (one pair of electrodes 15 and 16). Accordingly, it is prevented that the ink is used up in the middle of each step and the air is drawn into the tube 18. The contents of the steps and the total number of steps are designed to be appropriate for each type of the printer.

When the n-th step of the initial filling is completed in step S107, the processing moves on to step S108, and the value of the filling progressing flag k stored in the storage portion 50 is updated to n. Next, it is determined whether or not n reaches "e" in step S109. The "e" illustrates the total number of steps which configure the initial filling, and for example, "e" is set to be "8" in the example. When n does not reach e (step S109: NO), the steps after step S104 are performed again since the initial filling has not been completed. If n reaches e (step S109: YES), the initial filling flag is updated to "1" in step S112 in order to complete all of the steps which configure the initial filling.

As described above, in the example, since the control portion 40 performs the control (initial filling control in the example) which corresponds to the detection result of the ink residual amount level by the sensors (one pair of electrodes 15 and 16), it is possible to suppress the risk of the blank driving.

In addition, in the example, the initial filling of the ink IK to the printing head 22 is configured of the plurality of steps, the control portion 40 postpones the performing of the steps which are intended to be performed next (step S105: NO) when the result of the detection (step S104) of the ink residual amount level by the sensors (one pair of electrodes 15 and 16) is less than the first threshold value when performing (before performing) each step which configures the initial filling. Here, in the example, the first threshold value indicates the residual amount level L2 of FIG. 5.

Therefore, the residual amount of the ink IK becomes zero while performing the initial filling, and it is possible to prevent the generation of the so-called blank driving.

In addition, when the detection result of the ink residual amount level by the sensors (one pair of electrodes 15 and 16) in a state where the step which is intended to be performed next in the initial filling had been postponed, becomes equal to or greater than the first threshold value (step S105: YES), the control portion 40 moves on to performing the step which is intended to be performed next (steps S106 and S107).

Therefore, it is possible to omit the steps which have been already performed in the initial filing thereby becoming unnecessary.

In addition, when performing each step which configures the initial filling, the control portion 40 postpones the performing of the steps which are intended to be performed next when the detection result of the ink residual amount level by the sensors (one pair of electrodes 15 and 16) with respect to the ink tank of at least one of all ink tanks 11 is less than the first threshold value (step S105: NO).

Therefore, it is possible to prevent the generation of the blank driving with respect to all of the plural colors of ink.

Furthermore, the ink consumption amount of in a step where the ink consumption amount is the largest among the plurality of steps which configure the initial filling, is set to be less than the ink residual amount in the first threshold value in the ink tank 11. In the example, the first threshold value is the residual amount level L2 of FIG. 5, and the ink consumption amount in a step where the ink consumption amount is the largest among the plurality of steps which configure the initial filling is less than the amount obtained by adding the predetermined amounts C2 and C1 of FIG. 5. Accordingly, even though the ink residual amount level in the ink tank 11 is equal to or greater than the first threshold value, it is possible to prevent the amount of the ink from becoming zero while the predetermined step is performed.

In addition, when the detection result of the ink residual amount level at least by the sensors (one pair of electrodes 15 and 16) is less than the first threshold value, since the control portion 40 displays the contents related to the result of the detection on the display portion 47, the usability is improved.

Furthermore, in a case where the detection result of the ink residual amount level is equal to or greater than the first threshold value, it does not matter whether or not the display on the display portion 47 is performed.

Furthermore, the above-described first threshold value in the example is set to be the residual amount level L2 of FIG. 5 similar to those in the first example which has already been described, but it is possible to set the first threshold value to other level positions.

In addition, with respect to all of the steps which configure the initial filling in the example, the detection of the ink residual amount level is necessarily performed by the sensors (one pair of electrodes 15 and 16) before performing the steps, but for example, after detecting the ink residual amount level one time, the plurality of steps may be integrally performed. In addition, the detection of the ink residual amount level plural times may be performed in the first step.

In addition, as a result, in a case where the sensor end is determined, compared to a case where the sensor end is not determined, the time required for the initial filing increases.

Third Example

Next, a third example of the invention will be described with reference to FIG. 10. The example is an example which particularly focuses on the reset processing in the ink residual amount management. Furthermore, configurations of each portion of the printer in the example are similar to those in the first example which has already been described except for the parts that are not particularly mentioned. In addition, although not illustrated, between step S201 and step S202 which will be described later, a series of processing described with reference to FIG. 9, that is, the confirmation (step S101 of FIG. 9) of the ink initial filing-completed flag is performed, and the initial filling processing is performed when the initial filling has not been completed.

Figure 10:
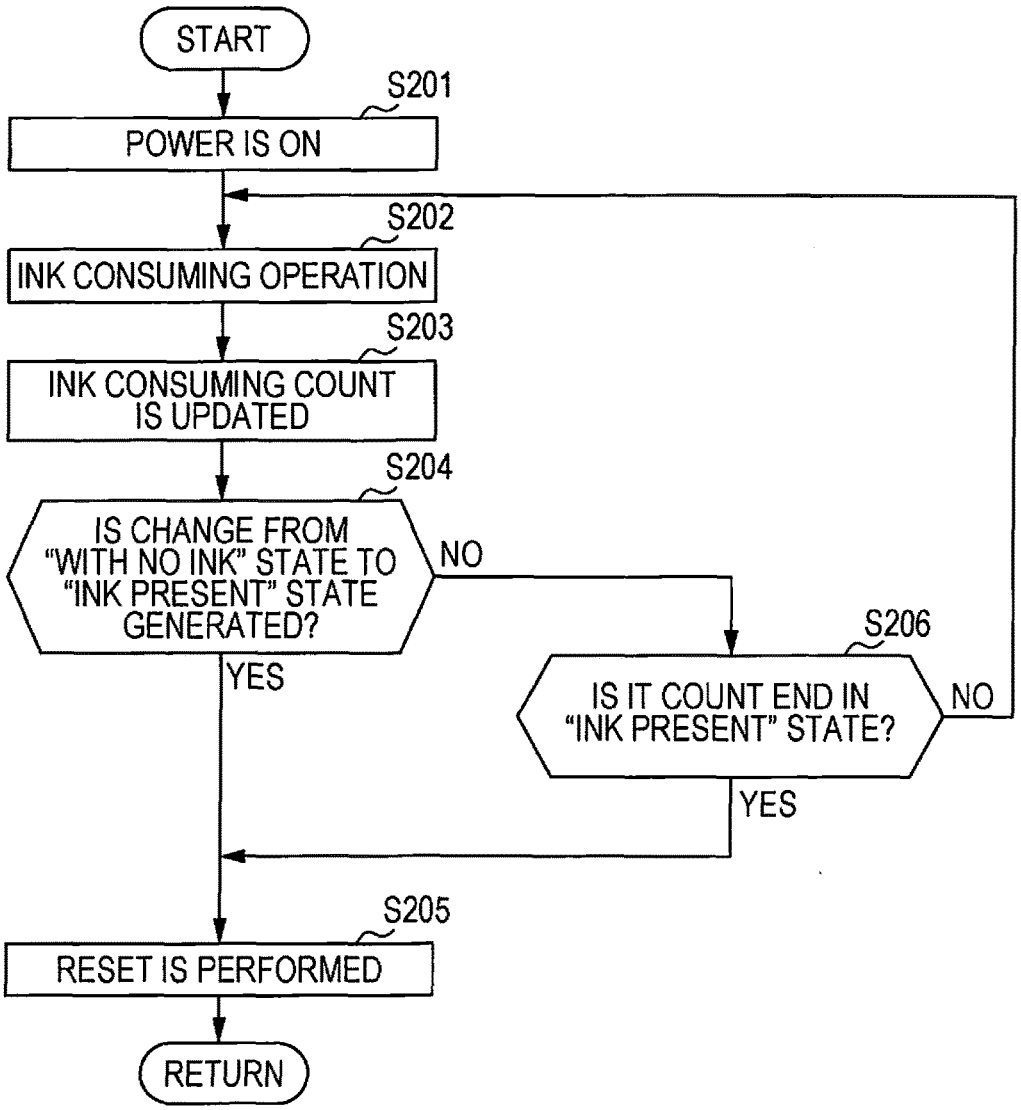
FIG. 10 is a flowchart illustrating a third example (ink residual amount management method) of the printer according to the invention.

In FIG. 10, when the power of the printer 110 is input (step S201), and the ink consumption operation is performed (step S202), the approximate consumption amount count 51 of FIG. 2 is processed similar to the above-described first example. In other words, every time the consumption amount calculation portion 42 calculates the ink consumption amount with respect to each ink tank 11, the approximate consumption amount count 51 is updated to the latest count value (step S203).

When the user refills the ink tank 11 with the ink IK and performs the reset processing by pressing the reset button, otherwise, when the "automatic reset processing" is performed by the software processing, the approximate consumption amount count 51 is cleared and returns to the initial value.

Next, the control portion 40 determines whether or not the detection result of the ink residual amount level in which the sensors (one pair of electrodes 15 and 16) are used is above the first threshold value after being below the first threshold value (step S204).

Furthermore, a state where the detection result of the ink residual amount level is below the first threshold value will be referred to as "with no ink" hereinafter, and a state where the detection result is equal to or greater than the first threshold value will be referred to as "ink present" hereinafter.

A change from the "with no ink" state to the "ink present" state can be determined when the detection result of the ink residual amount level by the sensors (one pair of electrodes 15 and 16) is above the first threshold value specifically after setting the sensor end flag 55.

In a case where the above-described change is generated (step S204: YES), the control portion 40 performs the reset processing so that it is possible to determine that the user refilled the ink tank 11 in the "with no ink" state with the ink IK (step S205). Accordingly, the approximate consumption amount count 51 returns to the initial value. In addition, the control portion 40 makes the processing return to the start.

Meanwhile, even though the change from the "with no ink" state to the "ink present" state is not generated (step S204: NO), in a case where the approximate consumption amount count 51 reaches the count end in the "ink present" state, that is, in a case where the approximate consumption amount count 51 reaches the count end while maintaining the "ink present" state (a state where the ink residual amount level is greater than the first threshold value), it is possible to determine that the user poured the ink in a state where the ink residual amount level is not low.

Therefore, even in this case (step S206: YES), the reset processing is performed (step S205). Accordingly, the approximate consumption amount count 51 returns to the initial value. In addition, the control portion 40 makes the processing return to the start. In this manner, it is possible to prevent an overflow of the count value of the ink consumption amount since the count value of the ink consumption amount is not permanently counted up. In addition, in a case where the approximate consumption amount count 51 reaches the count end in the "with no ink" state, since the ink is not present, the performing of the ink consumption operation is prohibited.

Furthermore, in the example, the control portion 40 uses the approximate consumption amount count 51 and the sensor end flag 55 of FIG. 2, but the count end flag 54 is not necessarily used (but may be used). In addition, the after-detection consumption amount count 52, the determination information 53, and the ink end flag 56 are also not necessarily used (but may be used). It is not necessary to hold information which is not used in the processing, in the storage portion 50. In other words, the example is an example which shows in which manner the reset processing is performed, and other types of processing are arbitrary.

In addition, in the example, unlike the above-described first example, when a state where the count value of the ink consumption amount reaches the predetermined limit value is considered as the "counter end", the limit value is set to be "the ink consumption amount (C5+C4+C3 of FIG. 5)+β (predetermined margin) when consuming the ink from the ink completely filled state (L5 of FIG. 5) to the first threshold value (for example, L2 of FIG. 5) in the ink tank 11".

However, the ink residual amount level assumed by the first threshold value may be at any position of FIG. 5. In other words, in the example, even though the detection result of the ink residual amount level by using the sensors (one pair of electrodes 15 and 16) exceeds the level where the ink is used up, and the ink is consumed, in a case where the detection result of the ink residual amount level is not changed to the "with no ink" state, it is considered that the user poured the ink into the ink tank 11, and the reset processing is performed. Therefore, the ink residual amount level assumed by the first threshold value can be set to an appropriate position.

As described above, even in the example, since the control portion 40 performs the control (the reset processing in the example) which corresponds to the detection result of the ink residual amount level by the sensors (one pair of electrodes 15 and 16), it is possible to suppress the risk of the blank driving.

In addition, in the example, while maintaining the "ink present" state, in a case where the count value of the ink consumption amount exceeds the consumption amount (for example, C5+C4+C3 in FIG. 5) when the ink IK is consumed from the state where the ink tank 11 is completely filled with the ink IK to the residual amount level that corresponds to the first threshold value, and reaches the predetermined amount, since the reset processing of making the approximate consumption amount count 51 which is the count value of the ink consumption amount return to the initial value is performed, it is possible to prevent an overflow of the count value of the ink consumption amount.

Fourth Example

Figure 11:
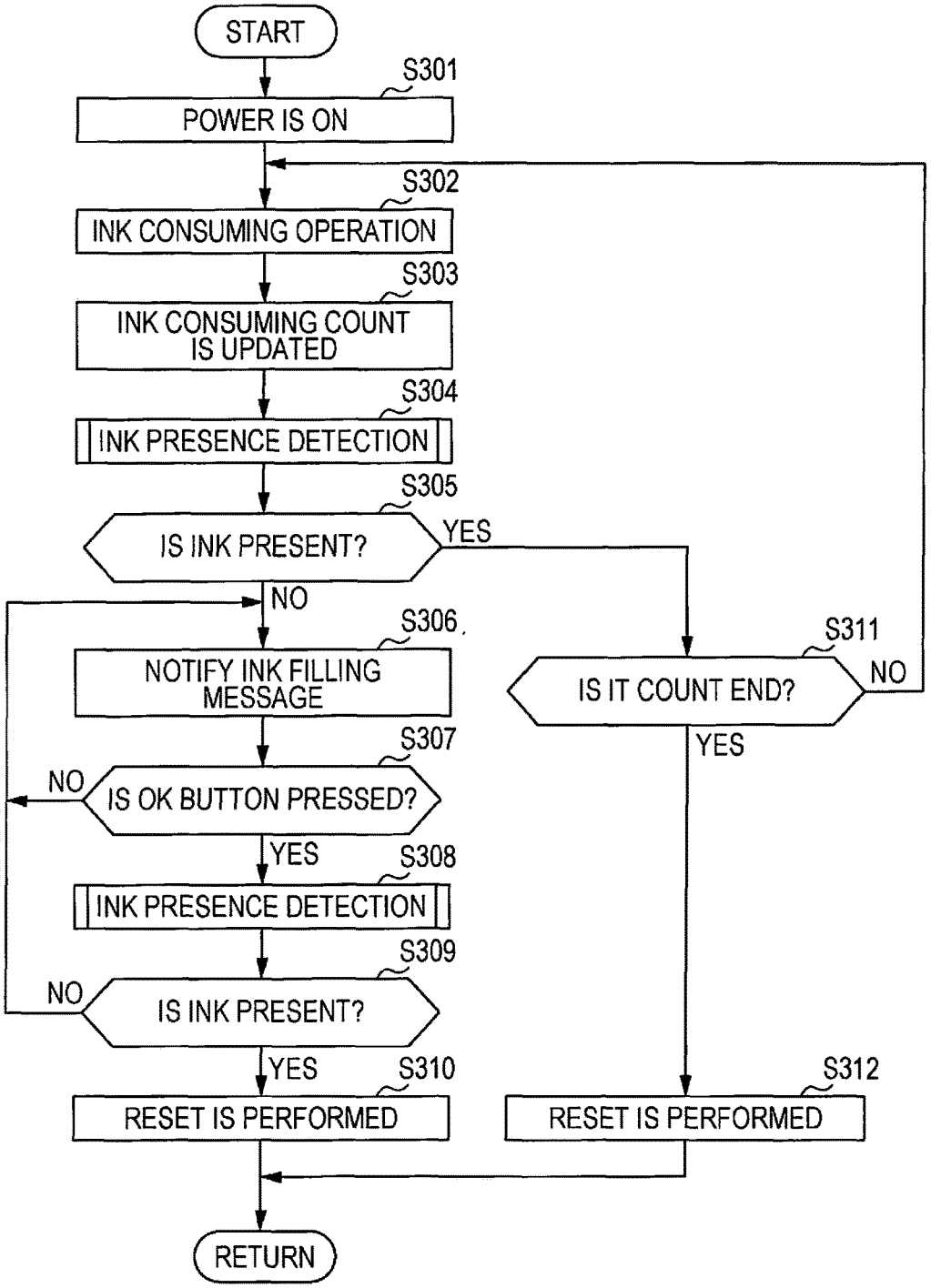
FIG. 11 is a flowchart illustrating a fourth example (ink residual amount management method) of the printer according to the invention.

Next, a fourth example of the invention will be described with reference to FIG. 11. The example is an example which particularly focuses on the reset processing in the ink residual amount management. Furthermore, configurations of each portion of the printer in the example are similar to those in the first example which has already been described except for the parts that are not particularly mentioned. In addition, although not illustrated, between step S301 and step S302 which will be described later, a series of processing described with reference to FIG. 9, that is, the confirmation (step S101 of FIG. 9) of the ink initial filing-completed flag is performed, and the initial filling processing is performed when the initial filling has not been completed.

In the example, it is assumed that the ink residual amount level (first threshold value) when the detection result of the ink residual amount level by using the sensors (one pair of electrodes 15 and 16) is switched from the "ink present" state to the "with no ink" state is set to be the residual amount level L0 (ink end) of FIG. 5 unlikely to the above-described third example.

When the power of the printer 110 is input (step S301), and the ink consumption operation is performed (step S302), the approximate consumption amount count 51 of FIG. 2 is processed similar to each of the above-described examples. In other words, every time the consumption amount calculation portion 42 calculates the ink consumption amount with respect to each ink tank 11, the approximate consumption amount count 51 is updated to the latest count value (step S303).

Next, the control portion 40 performs the detection of the ink residual amount level by using the sensors (one pair of electrodes 15 and 16) (step S304). In addition, in the following step S305, the control portion 40 determines whether or not the ink IK is present at the predetermined height (in the example, the residual amount level L0 illustrated in FIG. 5) in the ink tank 11 based on the detection result of the ink residual amount level.

In a case where it is determined that the ink is present in step S305 (step S305: YES), the control portion 40 proceeds the processing to step S311. Meanwhile, in a case where it is determined that the ink is not present, that is, the sensor end is determined in step S305 (step S305: NO), the control portion 40 proceeds the processing to step S306.

In a case where the sensor end is determined in step S305, since the ink residual amount level in the example is close to L0 (ink end) of FIG. 5, it is necessary to immediately refill the ink. Therefore, with respect to the ink tank 11 which is determined as the sensor end, the control portion 40 generates the data for displaying the contents (for example, the message "Please fill A color of ink") in order to prompt the user to fill the ink tank 11 with the ink IK, and outputs the data to the display portion 47 (step S306). The display of the display portion 47 continues until the user presses the OK button (step S307).

When the user fills the ink IK and presses the OK button (step S307: YES), the control portion 40 performs the ink presence detection by using the sensors (one pair of electrodes 15 and 16) again (step S308), and performs the ink presence determination (step S309), and if the ink is present (step S309: YES), the control portion 40 performs the reset processing (step S310). Accordingly, the approximate consumption amount count 51 returns to the initial value. In addition, the control portion 40 returns the processing to the start.

In a case where the ink is not present in step S309, the display for prompting the user to fill the ink tank with the ink IK continues to be performed (step S306).

Meanwhile, in a case where it is possible to determine that the ink is present (step S305: YES), the control portion 40 determines whether or not the approximate consumption amount count 51 reaches the count end (step S311). Even though it is determined that the ink is present in step S305, in a case where the approximate consumption amount count 51 reaches the count end (step S311: YES), it is possible to determine that the user poured the ink IK in a state where the ink residual amount level is not low.

Therefore, in this case (step S311: YES), the "automatic reset processing" is performed (step S312). Accordingly, the approximate consumption amount count 51 returns to the initial value. In addition, the control portion 40 makes the processing return to the start. In this manner, since the count value of the ink consumption amount does not exceed the count end, it is possible to prevent an overflow of the count value of the ink consumption amount.

Furthermore, in the example, even in any state of the sensor end and the count end, since the processing moves on to the reset processing (steps S310 and S312), the control portion 40 does not necessarily use (may use) the sensor end flag 55, the count end flag 54, and the ink end flag 56 of FIG. 2. In addition, the after-detection consumption amount count 52 and the determination information 53 are also not necessarily used (may be used). It is not necessary to hold information which is not used in the processing, in the storage portion 50. In other words, the example is an example which shows in which manner the reset processing is performed, and other types of processing are arbitrary.

In addition, in the example, the reset processing (step S310) by the sensor end and any processing of the reset processing (step S312) by the count end are similar to each other.

However, since the latter (step S312) is the reset processing in a case where there is a high possibility that the ink IK is poured by the user in the "ink present" state (not a recommended using method), processing (for example, a guide display related to the ink filling method to the user) which is different from the reset processing (step S310) by the sensor end may be added.

As described above, even in the example, since the control portion 40 performs the control (the reset processing in the example) which corresponds to the detection result of the ink residual amount level by the sensors (one pair of electrodes 15 and 16), it is possible to suppress the risk of the blank driving.

In addition, in the example, in a case where the count value of the ink consumption amount exceeds the consumption amount (for example, C5+C4+C3+C2+C1 in FIG. 5) when the ink IK is consumed from the state where the ink tank 11 is completely filled with the ink IK to the residual amount level that corresponds to the first threshold value, and reaches the predetermined amount, since the reset processing (step S310) of making the approximate consumption amount count 51 which is the count value of the ink consumption amount return to the initial value is performed, it is possible to prevent an overflow of the count value of the ink consumption amount.

Fifth Example

The printer 110 displays the ink residual amount on the display portion 47, or displays the ink residual amount on a communication destination computer. The ink residual amount is basically calculated based on the count value of the ink consumption amount, but in a case where the sensors (one pair of electrodes 15 and 16 in the example) show that the ink is present, no matter how much the count value of the ink consumption amount increases, the ink residual amount is not reduced from the ink residual amount (hereinafter, referred to as a sensor ink amount) which corresponds to the minimum ink amount in which the sensors show that the ink is present. In addition, in a case where the sensor is switched from the "ink present" state to the "with no ink", the ink residual amount is changed to the sensor ink amount, and from the sensor ink amount, the ink residual amount is reduced in accordance with the increase in the count value of the ink consumption amount.

Other Modification Examples

Each of the above-described examples merely shows one example of the invention, and it is possible to combine each example, and further to arbitrary modify and apply the examples within the range of the invention. As modification examples, for example, the following can be considered.

Modification Example 1

In the above-described embodiments, a configuration in which the refill ink IK is provided to be accommodated in the refill bottle, the volume of the refill bottle is less than the maximum consumable volume of the ink tank 11, and the entire amount of the ink IK accommodated in the refill bottle can be accommodated in the ink tank 11, is provided, but the invention is not limited to the aspect. For example, a configuration in which the volume of the refill bottle is greater than the maximum consumable volume of the ink tank 11, and the refill ink IK is provided to be accommodated not in a bottle-like container, but in a bag-like container, may be employed.

As described above, in the printer 110, since the control portion 40 determines the ink low and the ink end based on the count value by considering the moment when the sensor end is determined by the ink presence detection by the sensors as a standard, it is possible to correctly determine the ink low and the ink end even by the using method of repeatedly pouring and refilling the ink IK. Therefore, when the user refills the ink IK paying attention not to the ink IK not to be overflown from the ink tank 11, without paying close attention to the timing of refilling the ink IK or the refill amount, it is possible to use the printer 110 without generation of the blank driving state.

Modification Example 2

In the above-described embodiments, a configuration in which one pair of electrodes 15 and 16 are provided as the sensors, and it is determined whether or not the ink IK is present at the predetermined height in the ink tank 11 based on the resistance value between one pair of electrodes 15 and 16, is employed, but the invention is not limited to the aspect. For example, a configuration in which a light sensor including the light emitting portion and the light receiving portion is provided, and it is determined whether or not the ink IK is present at the predetermined height in the ink tank 11 by the difference in the strength of the light that is emitted by the light emitting portion and received by the light receiving portion, may be employed. At this time, a prism may be used as an optical path of detected light. In addition, a configuration in which a weight sensor is provide, and it is determined whether or not the ink IK is present at the predetermined height in the ink tank 11 by a difference in weight, may be employed. In addition, a configuration in which it is determined whether or not the ink IK is present at the predetermined height in the ink tank 11 by using a pressure sensor, such as a semiconductor piezoresistance diffusing pressure sensor or an electrostatic capacity type pressure sensor, may be employed. In addition, the sensor is not limited to the sensor which determines whether or not the ink IK is present at the predetermined height in the ink tank 11, and may be a sensor which determines whether or not the ink IK is present at the predetermined position in the ink tank 11, that is, a sensor for detecting whether or not the residual amount of the ink IK in the ink tank 11 is the predetermined amount.

Modification Example 3

The ink presence detection by the sensor may be performed at appropriate timing, may be periodically performed, or may be constantly performed. For example, according to the above-described embodiments, the conduction to one pair of electrodes 15 and 16 may be performed at predetermined timing, for example, only at necessary timing in the determination processing in the control portion 40, may be periodically performed at a predetermined time interval, or may be constantly performed. In addition, the control portion 40 may confirm an output state of the sensor at a necessary timing, may periodically confirm the output state, or may confirm the output state in accordance with interruption from the sensor.

Modification Example 4

The approximate consumption amount count 51 of FIG. 2 counts up the amount used of the ink IK in each of the above-described examples, but instead, may be a value which is obtained by adding and subtracting the ink consumption amount to and from the tank volume of the ink tank 11. In this case, an example of the initial volume is the entire volume of the ink tank 11.

Modification Example 5

In each of the above-described examples, the control portion 40 performs the "automatic reset processing" in a case where the approximate consumption amount count 51 reaches the count end while maintaining the "ink present" state, but instead of this, a message which prompts the user to manually perform the reset operation may be displayed on the display portion 47 (FIG. 2).

Modification Example 6

In the above-described fifth example, since the ink residual amount is basically calculated based on the count value of the ink consumption amount, the ink residual amount becomes full in a case where the count value of the ink consumption amount is reset, the ink residual amount may not be full because of the reset. For example, in a case of the reset of step S312 of the fourth example, a case where the user uses the ink IK while pouring the ink IK is assumed, but the possibility that the ink IK becomes full at the reset timing is low. Therefore, in this case, the ink residual amount is an amount which is determined in advance as the ink residual amount between the ink amount detected by the sensors (one pair of electrodes 15 and 16 in the above-described embodiment) and the completely filled ink residual amount.

Modification Example 7

Since the limit value (count end) of the count value of the ink consumption amount is the ink amount in the ink tank 11, the limit value is the count value of the ink consumption amount which corresponds to the maximum consumable volume of the ink tank 11 in the first example, but may be a value obtained by adding the margin (for example, 10% of the maximum consumable volume) in consideration of the generation of the deviation between the count value and the actual consumption amount. In addition, in a case where the approximate consumption amount count 51 reaches the count end while maintaining the "ink present" state, it is determined that the ink IK is poured by the user in a state where the ink residual amount level is not low, and the reset is performed. However, not being limited to the count end, the approximate consumption amount count 51 may perform the reset when reaching the second threshold value determined in advance while maintaining the "ink present" state. The second threshold value is a value obtained by adding the margin to the first threshold value or a value which is greater than the first threshold value, and is a value which is equal to or less than the count end value.

Modification Example 8

In the above-described embodiments, the printer system 100 which is a multifunction machine including the printer 110 that serves as a liquid consuming apparatus and the scanner 120 is described as an example, but the invention is not limited thereto. The liquid consuming apparatus may be a monofunction printer 110 which does not include the scanner 120.

Modification Example 9

In the above-described embodiments, an example in which the invention is employed as the printer and the ink tank is described, but the invention is not limited to the aspect. The invention may be used in the liquid consuming apparatus which ejects or discharges liquid other than the ink, and can also be employed in a liquid container in which the liquid is accommodated.

What is claimed is:

1. A liquid discharging apparatus comprising:

a liquid discharging unit which discharges liquid to a discharged medium after an initial filling for filling with the liquid;

a liquid accommodation portion which is provided with a pouring port through which a user pours the liquid, and which accommodates the liquid;

a sensor for detecting whether or not the level of the liquid in the liquid accommodation portion is equal to or greater than a first threshold value; and a control portion which performs the initial filling based on a result of the detection of the sensor, with the initial filling to the liquid discharging unit including a plurality of steps, wherein, in response to the result of the detection by the sensor being less than the first threshold value after one of the steps of the initial filing is performed, the control portion postpones performing of next one of the steps of the initial filing which is intended to be performed next to the one of the steps of the initial filing.

2. The liquid discharging apparatus according to claim 1, further comprising:

a plurality of liquid accommodation portions which accommodate plural types of liquid which are different from each other separately, wherein the control portion postpones the performing of an n-th step for all of the liquid accommodation portions when the result of the detection by the sensor with respect to at least one liquid accommodation portion among the liquid accommodation portions is less than the first threshold value, before performing the n-th step which configures the initial filling, where n is an integer that is equal to or more than 2.

3. The liquid discharging apparatus according to claim 1, wherein the consumption amount in a step where the consumption amount of the liquid is the largest among the plurality of steps which configure the initial filling is less than a residual amount of the liquid in the first threshold value in the liquid accommodation portion.

4. The liquid discharging apparatus according to claim 1, further comprising;

a display portion which performs various types of display with respect to the user, wherein the control portion displays contents related to the result of the detection on the display portion when the result of the detection by the sensor is at least less than the first threshold value.

5. A liquid discharging apparatus comprising:

a liquid discharging unit which discharges liquid to a discharged medium after an initial filling for filling with the liquid;

a liquid accommodation portion which is provided with a pouring port through which a user pours the liquid, and which accommodates the liquid;

a sensor for detecting whether or not the level of the liquid in the liquid accommodation portion is equal to or greater than a first threshold value; and a control portion which performs the initial filling which corresponds to a result of the detection of the sensor, wherein the initial filling to the liquid discharging unit is configured of a plurality of steps, wherein the control portion postpones performing of a step which is intended to be performed next when the result of the detection by the sensor is less than the first threshold value in a state where each step that configures the initial filling is performed, and wherein the control portion moves on to performing the step which is intended to be performed next when the result of the detection by the sensor is equal to or greater than the first threshold value in a state where the performing of the step which is intended to be performed next had been postponed in the initial filling.

6. The liquid discharging apparatus according to claim 5, further comprising:

a plurality of liquid accommodation portions which accommodate plural types of liquid which are different from each other separately, wherein the control portion postpones the performing of an n-th step for all of the liquid accommodation portions when the result of the detection by the sensor with respect to at least one liquid accommodation portion among the liquid accommodation portions is less than the first threshold value, before performing the n-th step which configures the initial filling, where n is an integer that is equal to or more than 2.

7. The liquid discharging apparatus according to claim 5, wherein the consumption amount in a step where the consumption amount of the liquid is the largest among the plurality of steps which configure the initial filling is less than a residual amount of the liquid in the first threshold value in the liquid accommodation portion.

8. A liquid discharging apparatus comprising:

a liquid discharging unit which discharges liquid to a discharged medium after an initial filling for filling with the liquid;

a liquid accommodation portion which is provided with a pouring port through which a user pours the liquid, and which accommodates the liquid;

a sensor for detecting whether or not the level of the liquid in the liquid accommodation portion is equal to or greater than a first threshold value; and a control portion which performs the initial filling which corresponds to a result of the detection of the sensor, wherein the control portion increases time required for the initial filling in a first case where the result of the detection by the sensor is equal to or greater than the first threshold value before starting the initial filling and the result of the detection by the sensor is less than the first threshold value during the initial filling, to be longer than that in a second case where the result of the detection by the sensor is equal to or greater than the first threshold value before starting the initial filling and the result of the detection by the sensor is also equal to or greater than the first threshold value at all times during the initial filling.

9. The liquid discharging apparatus according to claim 8, wherein the control portion increases the time required for the initial filling in a third case where the result of the detection by the sensor is equal to or greater than the first threshold value before starting the initial filling and the result of the detection by the sensor is less than the first threshold value during a period which is longer than that in the first case during the initial filling, to be longer than that in the first case.

10. A liquid discharging apparatus comprising:

a liquid discharging unit which discharges liquid to a discharged medium after an initial filling for filling with the liquid;

a liquid accommodation portion which is provided with a pouring port through which a user pours the liquid, and which accommodates the liquid;

a sensor for detecting whether or not the level of the liquid in the liquid accommodation portion is equal to or greater than a first threshold value; and a control portion which performs the initial filling which corresponds to a result of the detection of the sensor, wherein the control portion includes a consumption amount calculation portion which calculates the consumption amount of the liquid, and a count value which is updated based on the consumption amount of the liquid calculated by the consumption amount calculation portion, and wherein the control portion performs reset processing of making the count value return to a predetermined value when the consumption amount of the liquid reaches a predetermined amount which exceeds the consumption amount when the liquid is consumed to a residual amount level that corresponds to the first threshold value from a state where the liquid accommodation portion is completely filled with the liquid, in a state where the result of the detection by the sensor is equal to or greater than the first threshold value.

11. The liquid discharging apparatus according to claim 10, wherein the control portion prompts the user to perform a reset operation.

12. The liquid discharging apparatus according to claim 11, wherein the control portion performs the reset processing in response to the reset operation manually performed by the user after prompting the user to perform the reset operation.

13. The liquid discharging apparatus according to claim 10, wherein the predetermined value is a value between the count value corresponding to the first threshold value and the count value corresponding to a full residual amount.

14. The liquid discharging apparatus according to claim 10, wherein the predetermined value is the count value corresponding to a full residual amount.

* * * * *